US006896489B2

(12) United States Patent
Hunter et al.

(10) Patent No.: US 6,896,489 B2
(45) Date of Patent: May 24, 2005

(54) VARIABLE DISPLACEMENT VANE PUMP WITH VARIABLE TARGET REGULATOR

(75) Inventors: Douglas G. Hunter, Shelby Township, MI (US); Albin J. Niemiec, Romeo, MI (US)

(73) Assignee: BorgWarner Inc., Troy, MI (US)

( * ) Notice: Subject to any disclaimer, the term of this patent is extended or adjusted under 35 U.S.C. 154(b) by 0 days.

(21) Appl. No.: 10/021,566

(22) Filed: Dec. 12, 2001

(65) Prior Publication Data

US 2002/0114708 A1 Aug. 22, 2002

Related U.S. Application Data

(60) Provisional application No. 60/255,629, filed on Dec. 12, 2000.

(51) Int. Cl.[7] ..... F04B 49/00; F04C 29/10

(52) U.S. Cl. ..... 417/220; 418/30; 417/310

(58) Field of Search ..... 418/25, 26, 30, 418/31, 15, 16, 21, 22, 23, 24, 27, 28; 417/220, 307, 308, 309, 310, 311

(56) References Cited

U.S. PATENT DOCUMENTS

| | | | | |
|---|---|---|---|---|
| 2,716,946 A | | 9/1955 | Hardy | |
| 3,011,308 A | | 12/1961 | Wotring | |
| 3,204,859 A | | 9/1965 | Crooks | |
| 3,771,921 A | | 11/1973 | Rohde et al. | |
| 3,918,855 A | * | 11/1975 | Bornholdt | 418/24 |
| 3,973,881 A | | 8/1976 | Melchinger | |
| 4,014,305 A | | 3/1977 | Skinner et al. | |
| 4,035,105 A | * | 7/1977 | Dantlgraber | 417/220 |
| 4,222,718 A | * | 9/1980 | Lemke | 418/26 |
| 4,236,595 A | | 12/1980 | Beck et al. | |
| 4,259,039 A | | 3/1981 | Arnold | |
| 4,292,805 A | | 10/1981 | Acheson | |
| 4,325,215 A | | 4/1982 | Yamamoto | |
| 4,328,480 A | | 5/1982 | Keitel et al. | |
| 4,348,159 A | | 9/1982 | Acheson | |
| 4,369,743 A | | 1/1983 | Holt et al. | |

(Continued)

FOREIGN PATENT DOCUMENTS

| | | |
|---|---|---|
| CA | 23 85 897 | 11/2003 |
| DE | 32 304 32 | 2/1984 |
| DE | 32 386 50 | 4/1984 |
| DE | 34 46 603 | 1/1985 |
| DE | 3446603 A1 * | 7/1985 |

(Continued)

*Primary Examiner*—Charles G. Freay
(74) *Attorney, Agent, or Firm*—Warn, Hoffmann, Miller & LaLone, P.C.; Greg Dziegielewski

(57) ABSTRACT

A variable displacement vane-type fluid pump is provided which permits improved regulation of the pump discharge such that the pump can meet the various requirements of lubrication for internal combustion engines at all speeds with minimized use of power. Of course, the vane pump may also be utilized in a wide range of power transmission and other fluid distribution applications. The variable displacement vane pump of the invention may utilize both hydrostatic and mechanical assistance in radially positioning its vanes to ensure efficient and quiet operation of the pump and to facilitate priming of the pump. The vane pump of the invention may also use both hydrostatic and mechanical actuators to control the position of its containment ring or eccentric ring and hence, regulate the output of the pump. According to yet another aspect of the present invention, to prevent inlet flow restriction or cavitation, a valve may be provided to permit some of the pump outlet or discharge flow to bleed into the pump inlet to provide needed velocity and energy to the fluid flow into the pump inlet.

160 Claims, 9 Drawing Sheets

U.S. PATENT DOCUMENTS 4,450,818 A 5/1984 Thoma et al.
4,468,173 A * 8/1984 Dantlgraber ..... 417/220
4,496,288 A 1/1985 Nakamura et al.
4,510,962 A 4/1985 Mott et al.
4,531,706 A 7/1985 Weiger et al.
4,531,898 A 7/1985 Ideta
4,538,974 A 9/1985 Stich et al.
4,632,638 A * 12/1986 Shibayama et al. ..... 417/218
4,693,081 A 9/1987 Nakamura et al.
4,710,106 A * 12/1987 Iwata et al. ..... 417/213
4,738,330 A 4/1988 Suzuki et al.
4,740,142 A 4/1988 Rohs et al.
4,754,738 A 7/1988 Grohn et al.
4,774,918 A 10/1988 Kurio et al.
4,803,969 A 2/1989 Hiereth et al.
4,825,692 A 5/1989 Rohs et al.
4,850,269 A * 7/1989 Hancock et al. ..... 99/323.1
4,905,807 A 3/1990 Rohs et al.
4,974,562 A 12/1990 Ishii et al.
4,976,230 A 12/1990 Voigt
5,017,098 A 5/1991 Hansen et al.
5,052,896 A * 10/1991 Fischer et al. ..... 417/220
5,063,895 A 11/1991 Ampferer
5,067,454 A 11/1991 Waddington et al.
5,078,233 A 1/1992 Oetting et al.
5,085,187 A 2/1992 Black
5,090,881 A 2/1992 Suzuki et al.
5,101,789 A 4/1992 Voigt et al.
5,105,679 A 4/1992 Voigt
5,141,418 A * 8/1992 Ohtaki et al. ..... 418/26
5,190,003 A 3/1993 Voigt
5,195,474 A 3/1993 Urata et al.
5,239,885 A 8/1993 Voigt
5,273,020 A 12/1993 Hayami
5,315,971 A 5/1994 Yamada
5,339,776 A 8/1994 Regueiro
5,353,753 A 10/1994 McGrath et al.
5,355,851 A 10/1994 Kamiya
5,390,635 A 2/1995 Kidera et al.
5,398,505 A * 3/1995 Oogushi et al. ..... 60/426
5,404,855 A 4/1995 Yen et al.
5,435,698 A 7/1995 Phillips
5,465,699 A 11/1995 Voigt
5,467,843 A 11/1995 Esch et al.
5,484,271 A 1/1996 Stich
5,485,725 A 1/1996 Teraoka
5,490,770 A 2/1996 Oogushi
5,544,628 A 8/1996 Voigt
5,545,014 A * 8/1996 Sundberg et al. ..... 417/204
5,545,018 A * 8/1996 Sundberg ..... 418/30
5,588,504 A 12/1996 Spiegel et al.
5,618,165 A 4/1997 Larsson et al.
5,630,383 A 5/1997 Kidera et al.
5,690,479 A 11/1997 Lehmann et al.
5,752,815 A 5/1998 Muller
5,797,732 A 8/1998 Watanabe et al.
5,800,131 A 9/1998 Lehmann et al.
5,826,556 A 10/1998 Ruman et al.
5,863,189 A 1/1999 Sundberg et al.
5,904,126 A 5/1999 McKay et al.
5,918,573 A 7/1999 Killion
5,921,758 A 7/1999 Anamoto et al.
5,996,541 A 12/1999 Voigt et al.
6,053,137 A 4/2000 Trzmiel et al.
6,065,433 A 5/2000 Hill
6,079,380 A 6/2000 Jorgensen et al.
6,131,539 A 10/2000 Thomas
6,155,797 A 12/2000 Kazuyoshi
6,202,016 B1 3/2001 Stephenson et al.
6,216,651 B1 4/2001 Ishikawa et al.
6,408,975 B1 6/2002 Bishop et al.
6,488,479 B1 12/2002 Berger
6,524,076 B2 2/2003 Konishi
6,615,683 B1 9/2003 Voigt
6,669,439 B2 12/2003 Kardasz et al.
2001/0036412 A1 11/2001 Konishi

FOREIGN PATENT DOCUMENTS

DE 36 217 20 1/1987
DE 37 11 792 10/1987
DE 37 295 45 3/1988
DE 37 423 15 7/1988
DE 38 243 98 2/1989
DE 43 02 610 1/1993
DE 40 28 549 7/2003
DE 40 38 549 7/2003
DE 102 37 801 7/2003
EP 1 076 164 2/2001
EP 1 130 262 9/2001
EP 1 316 683 6/2003
EP 1 350 930 10/2003
FR 2 597 546 10/1987
FR 2 673 676 9/1992
JP 62 294 790 12/1987
JP 62294790 A * 12/1987 ..... F04C/15/04
JP 8 14164 1/1996
JP 2001 159395 6/2001
JP 02001173575 A * 6/2001
JP 2001 173575 6/2001
JP 2001-294166 10/2001
WO WO 01/55597 8/2001
WO WO 01/79703 10/2001
WO WO 03/058071 7/2003

* cited by examiner

VARIABLE DISPLACEMENT VANE PUMP WITH VARIABLE TARGET REGULATOR

CROSS REFERENCE TO RELATED APPLICATIONS

This application claims the benefit of U.S. Provisional Application Ser. No. 60/255,629, titled "Variable Displacement Pump and Method," filed Dec. 12, 2000.

FIELD OF THE INVENTION

This invention relates generally to fluid pumps and more particularly to a variable displacement vane pump.

BACKGROUND OF THE INVENTION

Hydraulic power transmission assemblies and fluid distribution systems may utilize a vane-type pump. Such pumps typically have a rotor with a plurality of circumferentially spaced vanes rotatably carried by the rotor and slidable relative thereto in slots provided in the rotor. The rotor and vanes cooperate with the internal contour of a containment ring or eccentric ring eccentrically mounted relative to an axis of the rotor and vanes to create fluid chambers between the containment ring or eccentric ring, rotor and vanes. Due to the eccentricity between the containment ring or eccentric ring and the rotor and vanes, the fluid chambers change in volume as they are moved with the rotating rotor and become larger in volume as they are moved across an inlet port and smaller in volume across an outlet port. To vary the eccentricity between the containment ring or eccentric ring and the rotor, the containment ring or eccentric ring may be pivoted upon a fixed axis in a pump housing. Pivoting the containment ring or eccentric ring varies the change in volume of the fluid chambers in use of the pump and hence, varies the displacement characteristic of the pump.

Side plates carried by the pump housing enclose the containment ring or eccentric ring, the rotor and the vanes, and provide passages through which fluid flows to and from the rotor and vanes. These passages, along with timing grooves and the containment ring or eccentric ring contour define pump cycles or zones, namely a fill or inlet zone, a precompression zone from the inlet to the outlet, a displacement or discharge zone, and a decompression zone from the outlet to the inlet.

In current vane-type pumps, the containment ring or eccentric ring is pivoted and oriented by a fluid pressure signal applied to a piston or directly to the containment ring which pivots the containment ring or eccentric ring against the bias of a fixed spring. In other words, a single fluid pressure signal is used to pivot the containment ring or eccentric ring. Accordingly, the control of the containment ring or eccentric ring is essentially limited to a pressure relief type control wherein the containment ring or eccentric ring is pivoted against the bias of the spring only when a sufficient pressure is applied to the piston or containment ring or eccentric ring. When the fluid pressure applied to the piston is not sufficient to move the containment ring or eccentric ring against the bias of a fixed spring, the position of the containment ring or eccentric ring is determined by the spring which limits to one regulation profile characteristic.

Additionally, it has been recognized that for efficient and quiet operation of a vane-type pump it is desirable to maintain the vanes in continuous contact with the containment ring or eccentric ring. Some vane-type pumps depend upon centrifugal force to maintain the contact between the vanes and the containment ring or eccentric ring. These pumps may lack positive and continuous contact between the vane and containment ring or eccentric ring resulting in adverse wear and decreased pump performance. One method to improve the contact between the vanes and the containment ring or eccentric ring involves applying a discharge fluid pressure to chambers or slots in the rotor in which the vanes are received. The fluid pressure drives the vanes radially outwardly and into contact with the containment ring or eccentric ring. However, in at least some conditions, the vanes have a tendency to remain in the rotor slots and the centrifugal force of the spinning rotor is not sufficient to overcome the viscous drag force on the vanes. Without the vanes extending radially outwardly from the rotor, the rotating rotor displaces little if any fluid such that there is little or no discharge pressure. Accordingly, there is little or no discharge pressure communicated to the vane slots and tending to force the vanes radially outwardly from the rotor. Hence, the pump will not prime.

SUMMARY OF THE INVENTION

A variable displacement vane-type fluid pump is provided which has a regulated discharge controlled at least in part by a pair of pilot pressure signals. Desirably, the vane pump of the invention permits improved regulation of the pump discharge such that the pump can meet the various requirements of lubrication for internal combustion engines at all speeds. Of course, the vane pump may also be utilized in power transmission and other fluid distribution applications. The variable displacement vane pump of the invention may utilize both hydrostatic and mechanical assistance in radially positioning its vanes to ensure efficient and quiet operation of the pump and to facilitate priming of the pump. The vane pump of the invention may also use both hydrostatic and mechanical actuators to control the position of its containment ring or eccentric ring and hence, regulate the output of the pump. According to yet another aspect of the present invention, to prevent inlet flow restriction or cavitation, a valve may be provided to permit some of the pump outlet or discharge flow to exhaust into the pump inlet to provide needed velocity energy to the fluid flow in the pump inlet.

To achieve the dual pilot pressure regulation of the pump output the vane pump has a pair of actuators each operable to position the containment ring or eccentric ring as desired. In one embodiment of the invention, the actuators are opposed pistons that are each actuated by a separate pilot pressure signal to pivot the cam as a function of the pressure signals. In another embodiment, a seal may be provided between the containment ring or eccentric ring and the pump housing defining separate chambers, the chambers receive pressurized fluid bearing directly on the containment ring or eccentric ring to position it and function as the actuators without any pistons between the fluid signal and the containment ring or eccentric ring. In any of the embodiments, the cam may be biased in one or both directions of its pivotal movement, such as by one or more springs.

To ensure priming of the pump and development of discharge pressure, one or more rings lie adjacent to the rotor radially inwardly of the vanes to ensure that at least some of the vanes extend radially outwardly beyond the rotor and in contact with the contoured ring at all times. Preferably, hydrostatic pressure is employed in chambers behind the vanes to provide full extension of the vanes and maintain them in continuous contact with the containment ring or eccentric ring.

Accordingly, some of the objects, features and advantages of this invention include providing an eccentric vane pump which enables improved control of the pump discharge, ensures priming of the pump, reduces inlet flow restriction and cavitation, enables pressure signals from two or more points in the hydraulic circuit to be used to regulate pump discharge, strategically positions the cam and its pivot to minimize movement in the direction perpendicular to the desired direction of movement of the eccentric ring as it pivots, is of relatively simple design and economical manufacture and assembly, is durable, reliable and has a long and useful life in service.

BRIEF DESCRIPTION OF THE DRAWINGS

These and other objects, features and advantages of this invention will be apparent from the following detailed description of the preferred embodiments, appending claims and accompanying drawings in which:

DETAILED DESCRIPTION OF THE PREFERRED EMBODIMENTS

Figure 1:
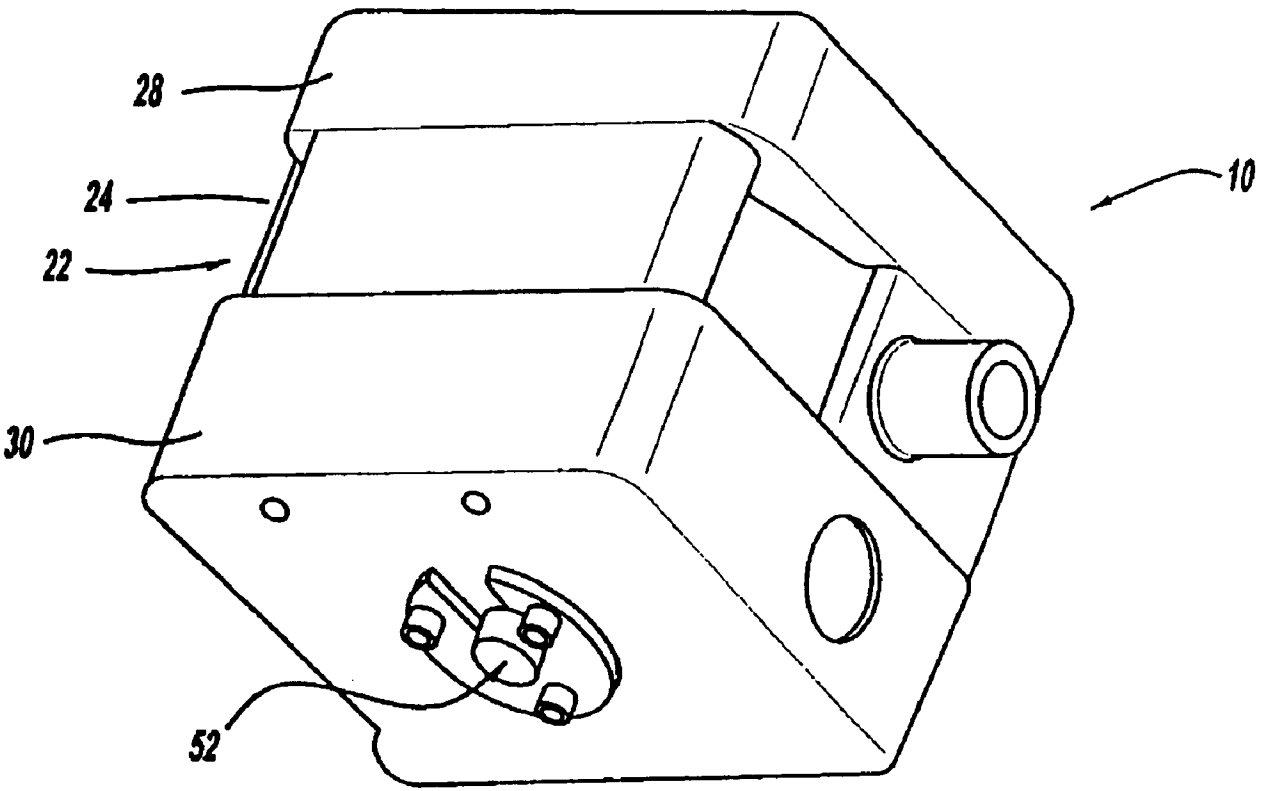
FIG. 1 is a perspective view of a variable displacement eccentric vane pump according to the present invention.
Figure 2:
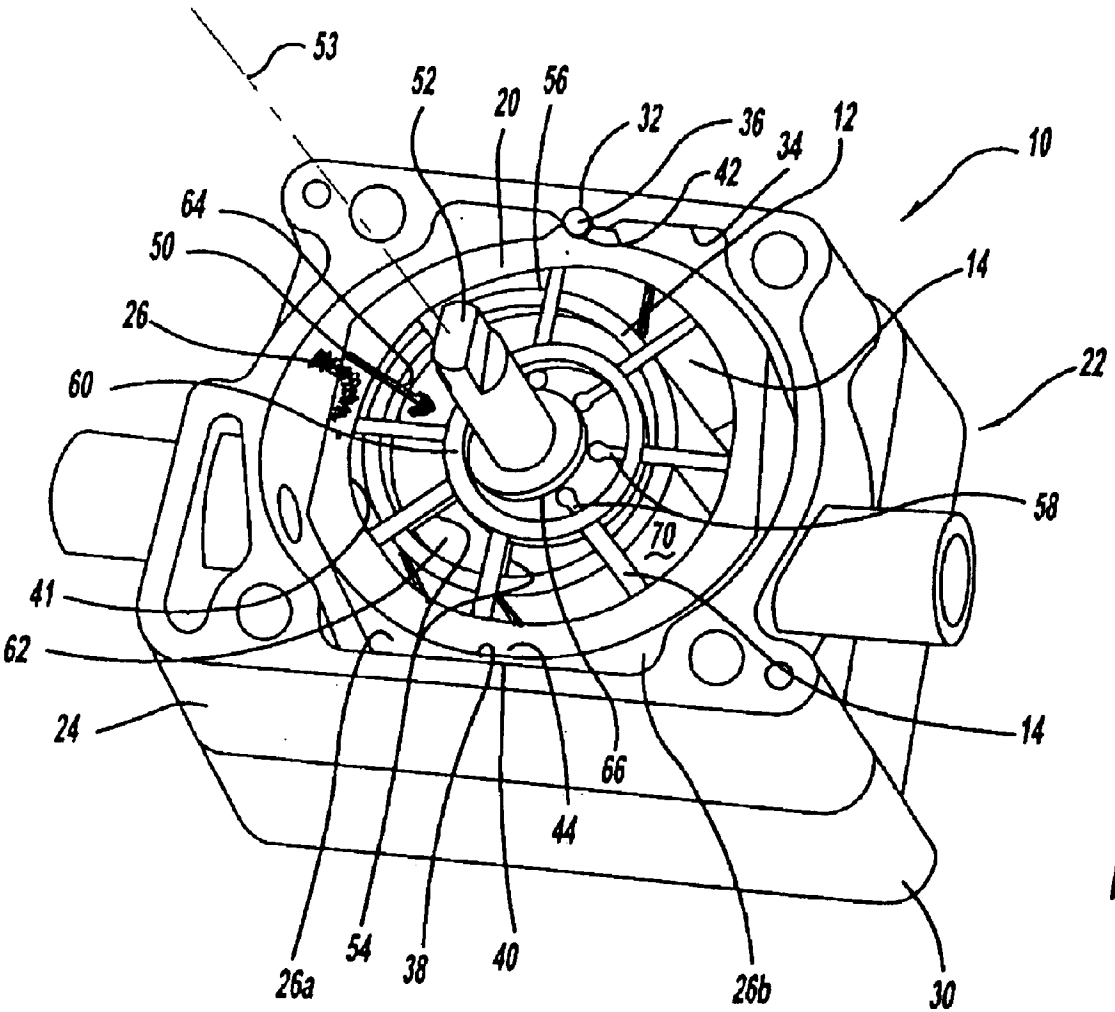
FIG. 2 is a perspective view of the vane pump of FIG. 1 with a side plate removed to show the internal components of the pump.
Figure 3:
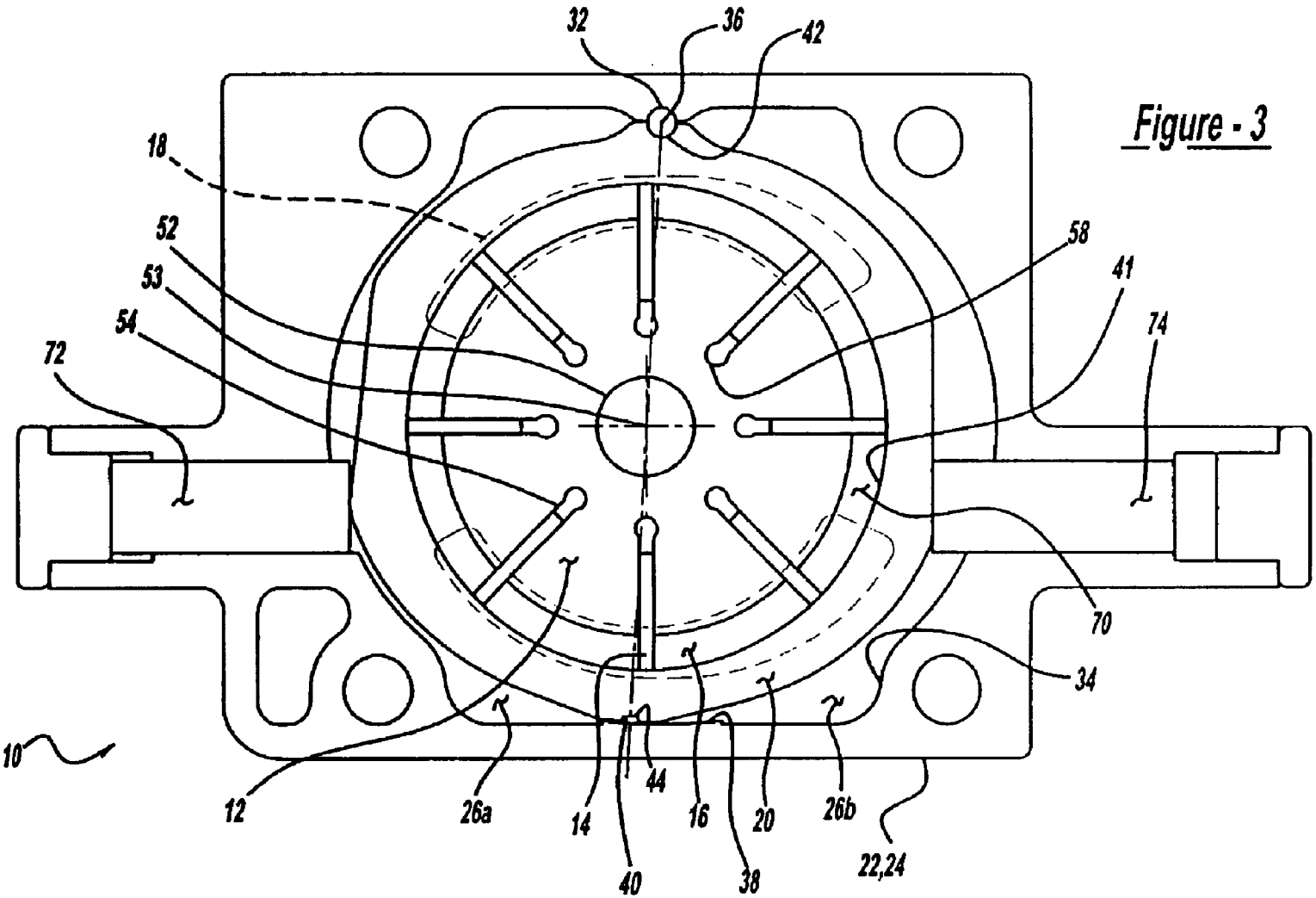
FIG. 3 is a plan view of the pump as in FIG. 2 illustrating the containment ring or eccentric ring in its zero-displacement position.

Referring in more detail to the drawings, FIGS. 1–3 illustrate a variable displacement vane pump 10 having a rotor 12 and associated vanes 14 driven for rotation to draw fluid through a pump inlet 16, increase the pressure of the fluid, and discharge the fluid under pressure from an outlet 18 of the pump 10. A containment ring or eccentric ring 20 is carried by a housing 22 of the pump 10 and is pivoted relative to the rotor 12 to vary the displacement of the pump. Such a pump 10 is widely used in a plurality of fluid applications including engine lubrication and power transmission applications.

The housing 22 preferably comprises a central body 24 defining an internal chamber 26 in which the containment ring or eccentric ring 20 and rotor 12 are received. The housing 22 further includes a pair of end plates 28,30 on opposed, flat sides of the central body 24 to enclose the chamber 26. A groove 32 formed in an internal surface 34 of the central body 24 is constructed to receive a pivot pin 36 between the containment ring or eccentric ring 20 and housing 22 to permit and control pivotal movement of the containment ring or eccentric ring 20 relative to the housing 22. Spaced from the groove 32 and preferably at a generally diametrically opposed location, a seat surface 38 is provided in the central body 24. The seat surface 38 is engageable with the containment ring or eccentric ring 20 in at least certain positions of the containment ring or eccentric ring to provide a fluid tight seal between them. One or both of the containment ring or eccentric ring 20 and central body 24 may carry an elastomeric or other type seal 40 that defines at least in part the seat surface.

Figure 10:
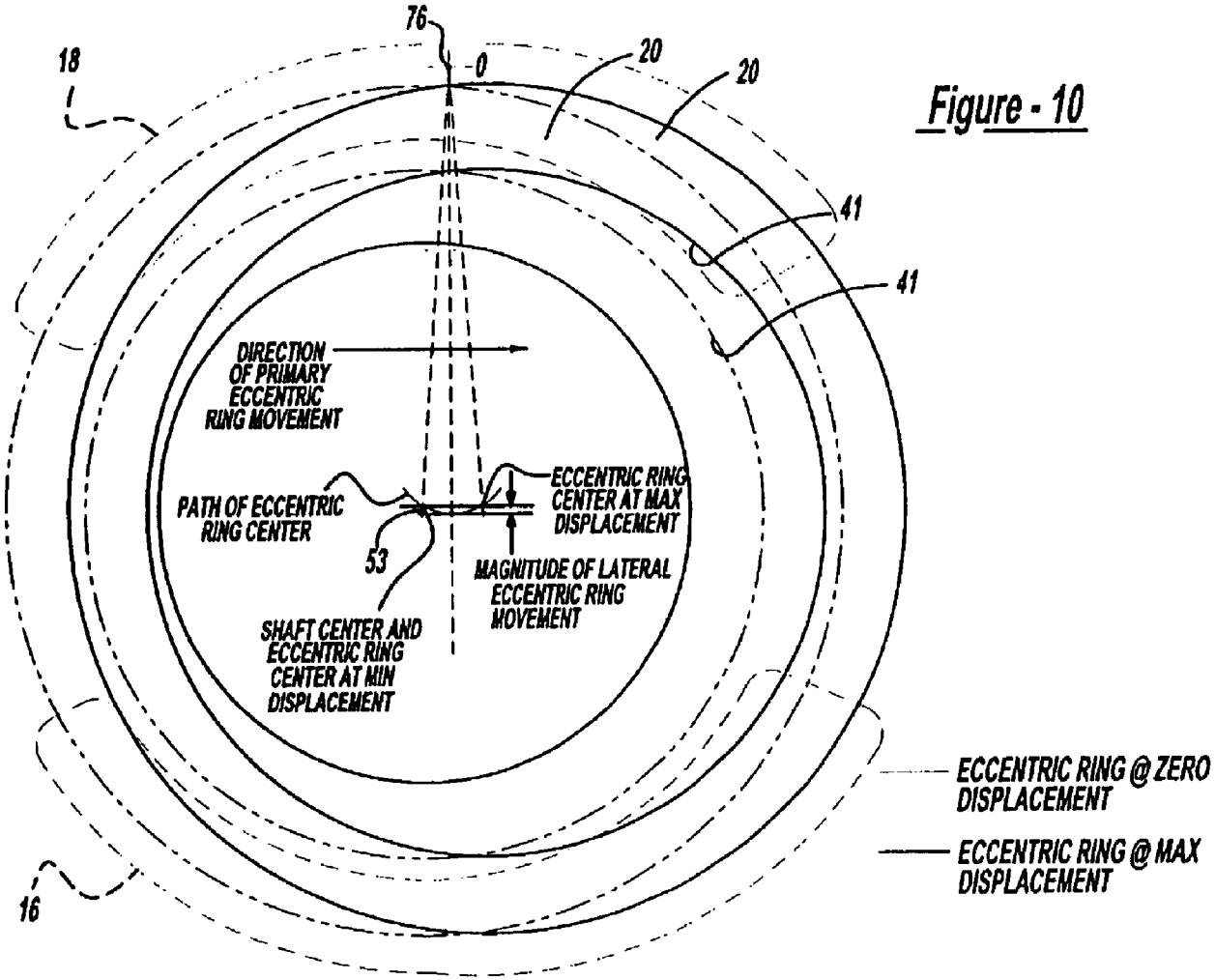
FIG. 10 is a diagrammatic view of the containment ring or eccentric ring of the vane pump in its zero-displacement and maximum-displacement positions.
Figure 1:
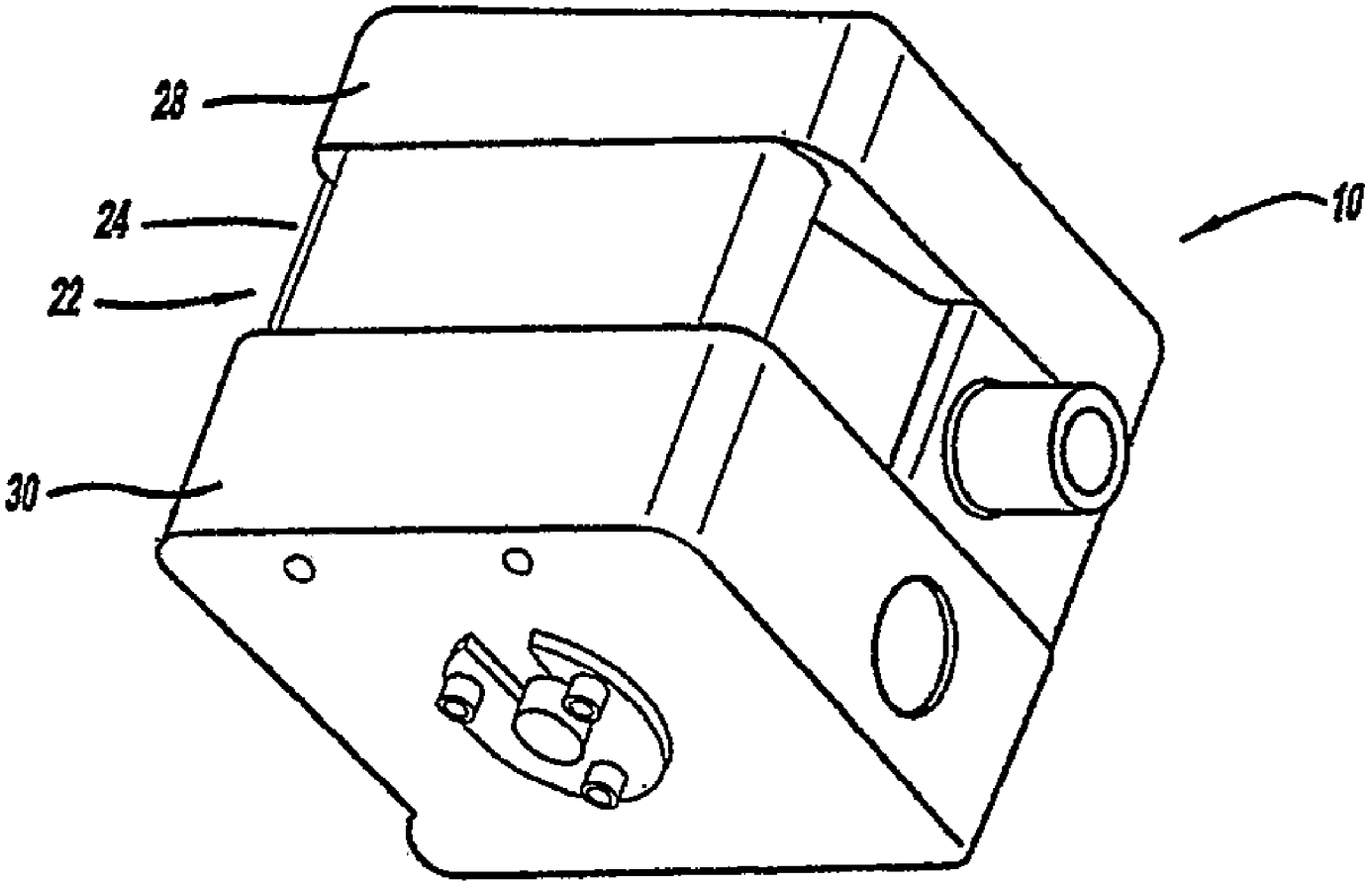
Figure 2:
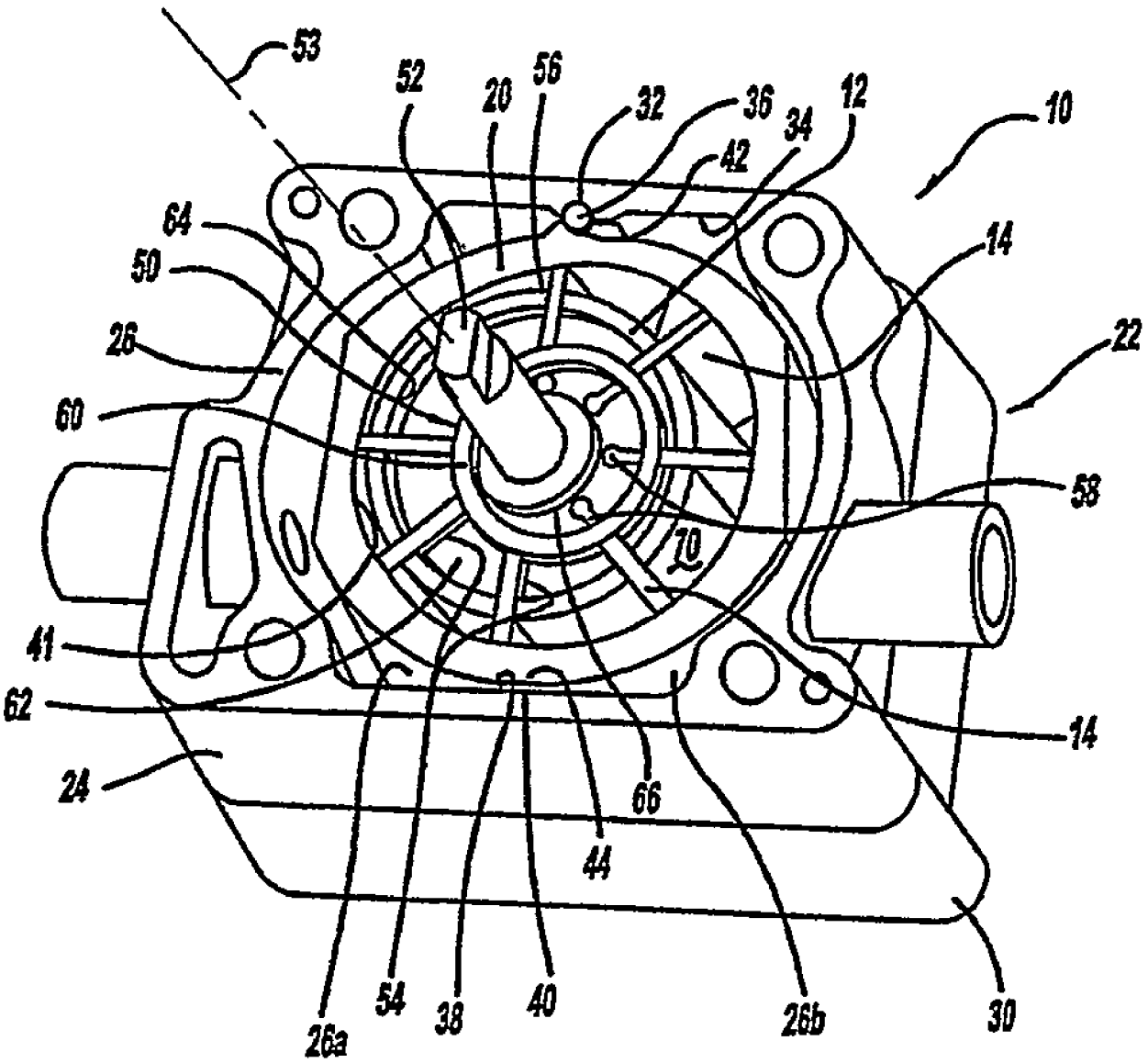
Figure 3:
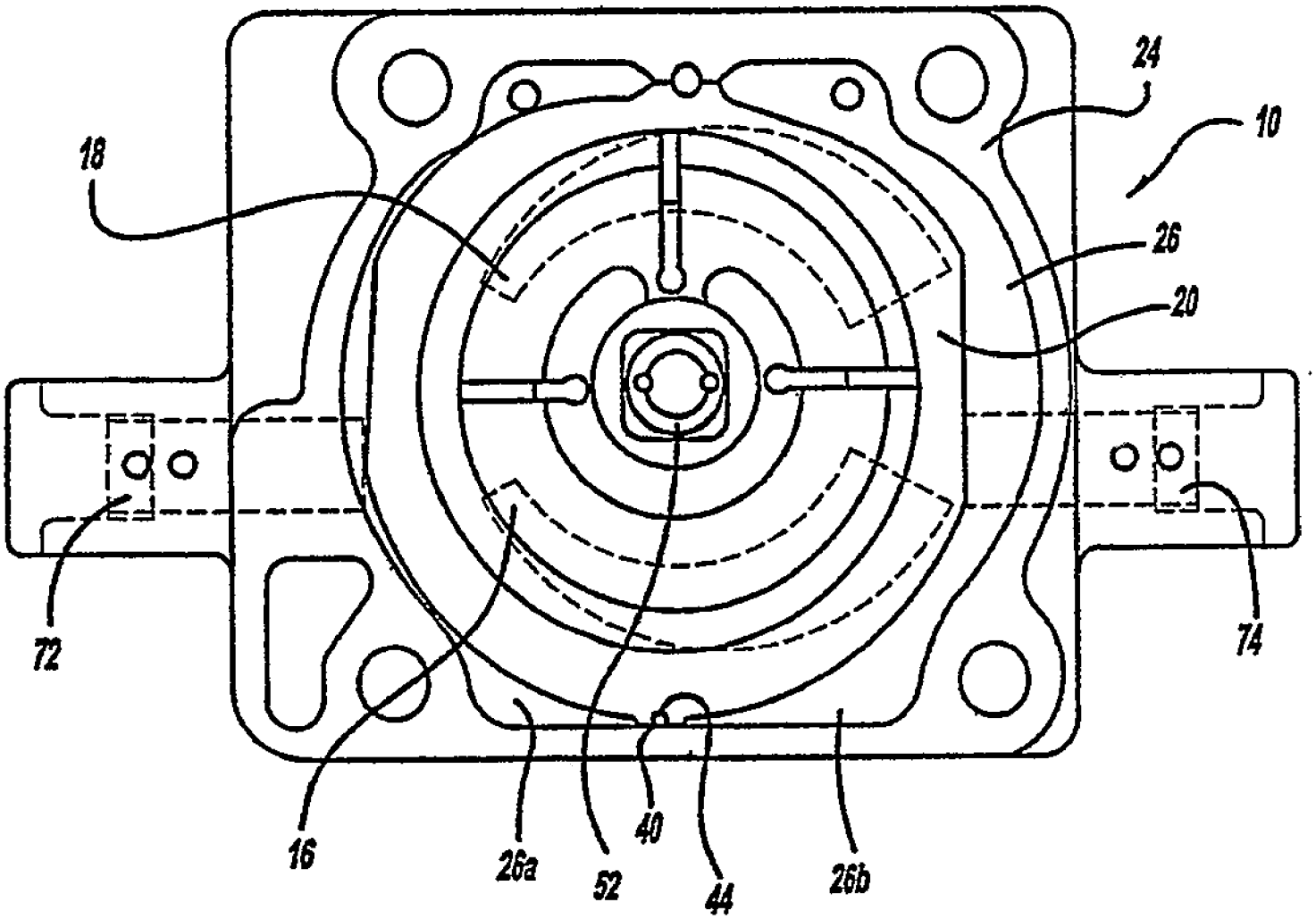
Figure 4:
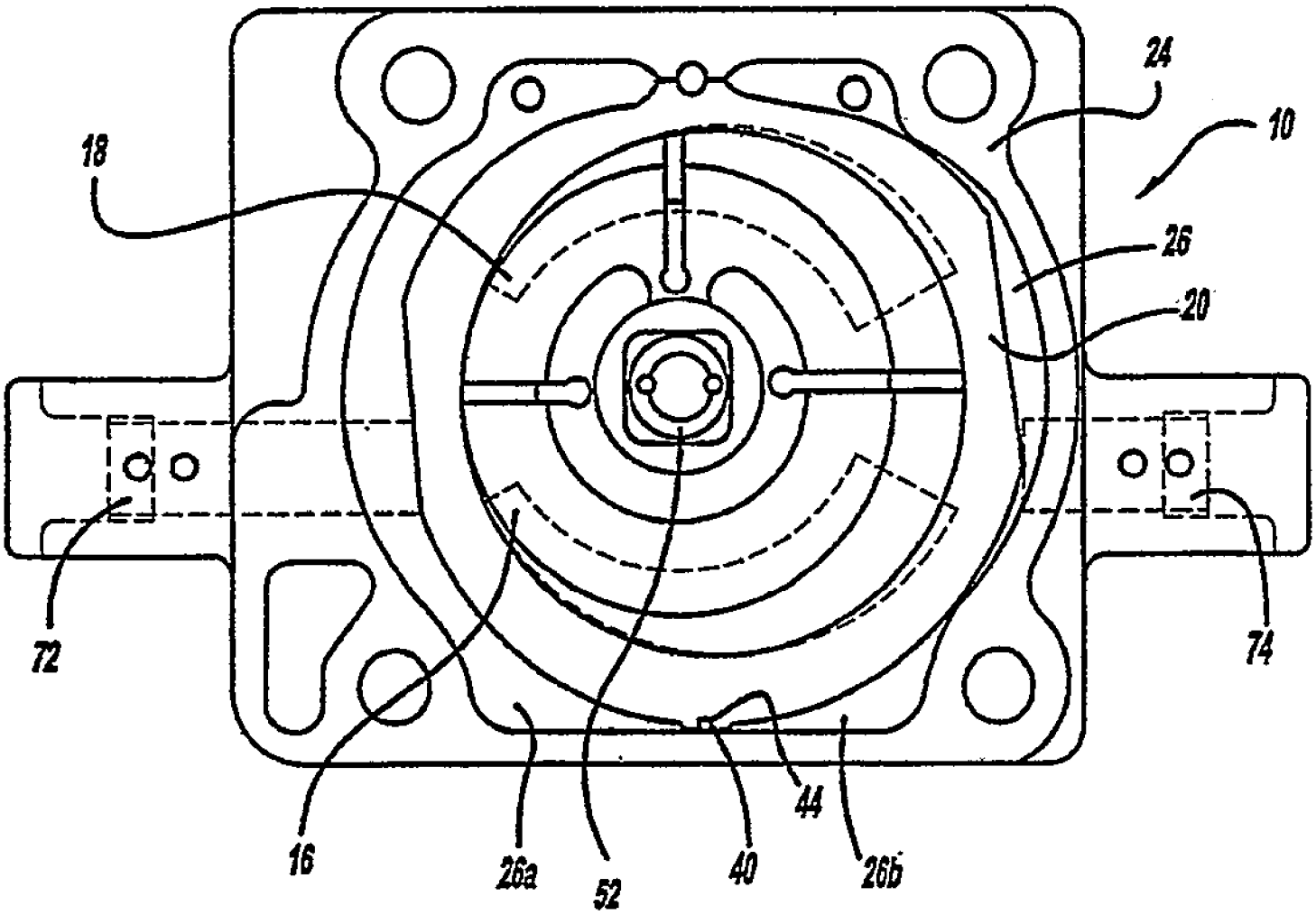
Figure 5:
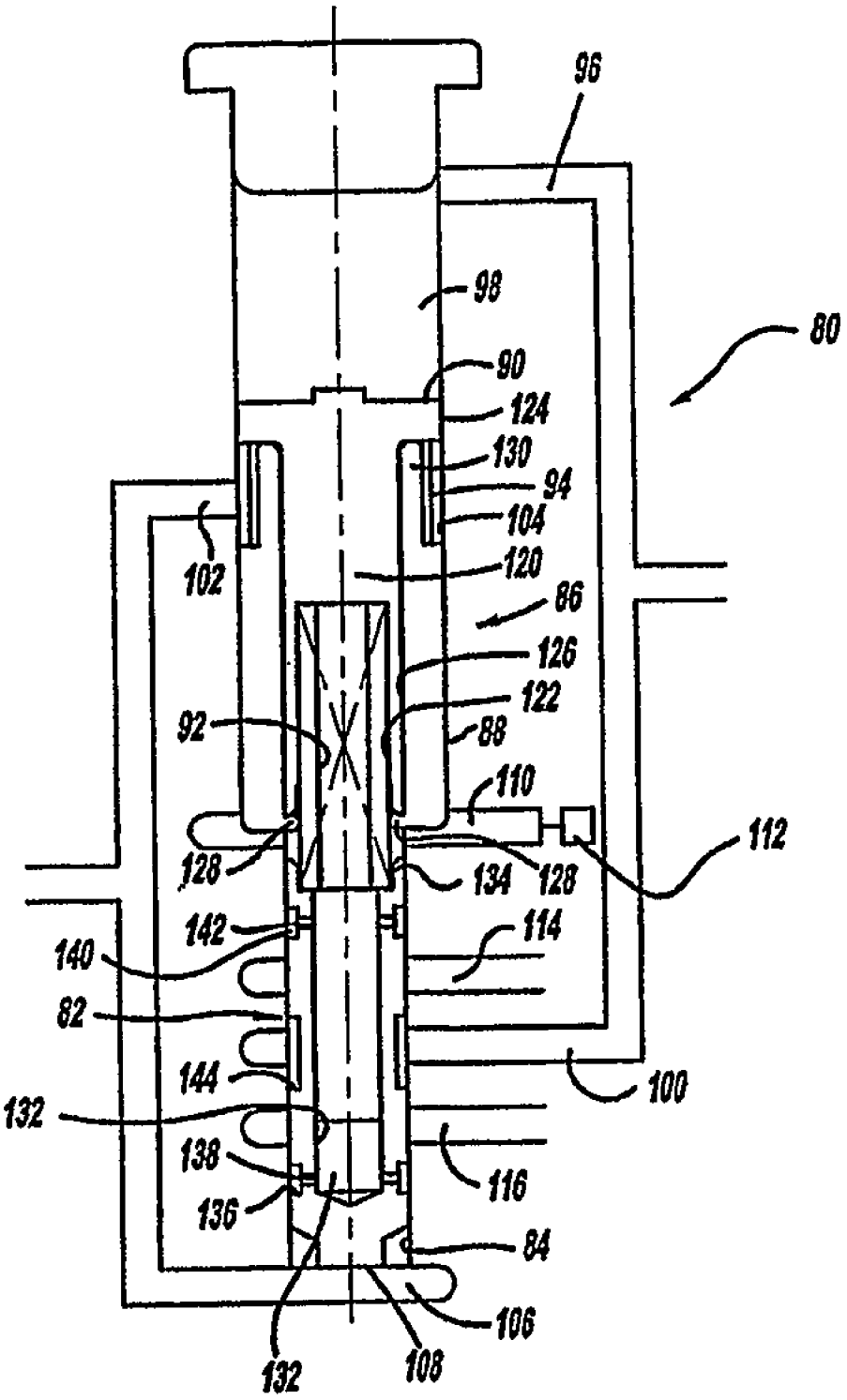
Figure 6:
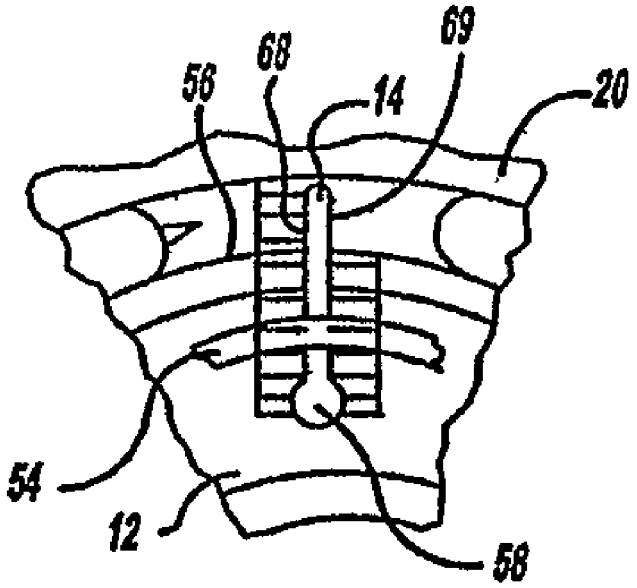
Figure 7:
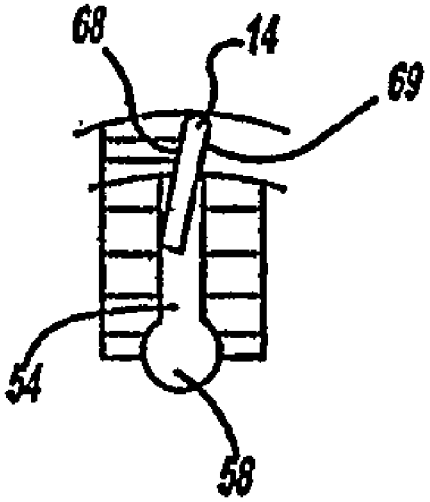
Figure 8:
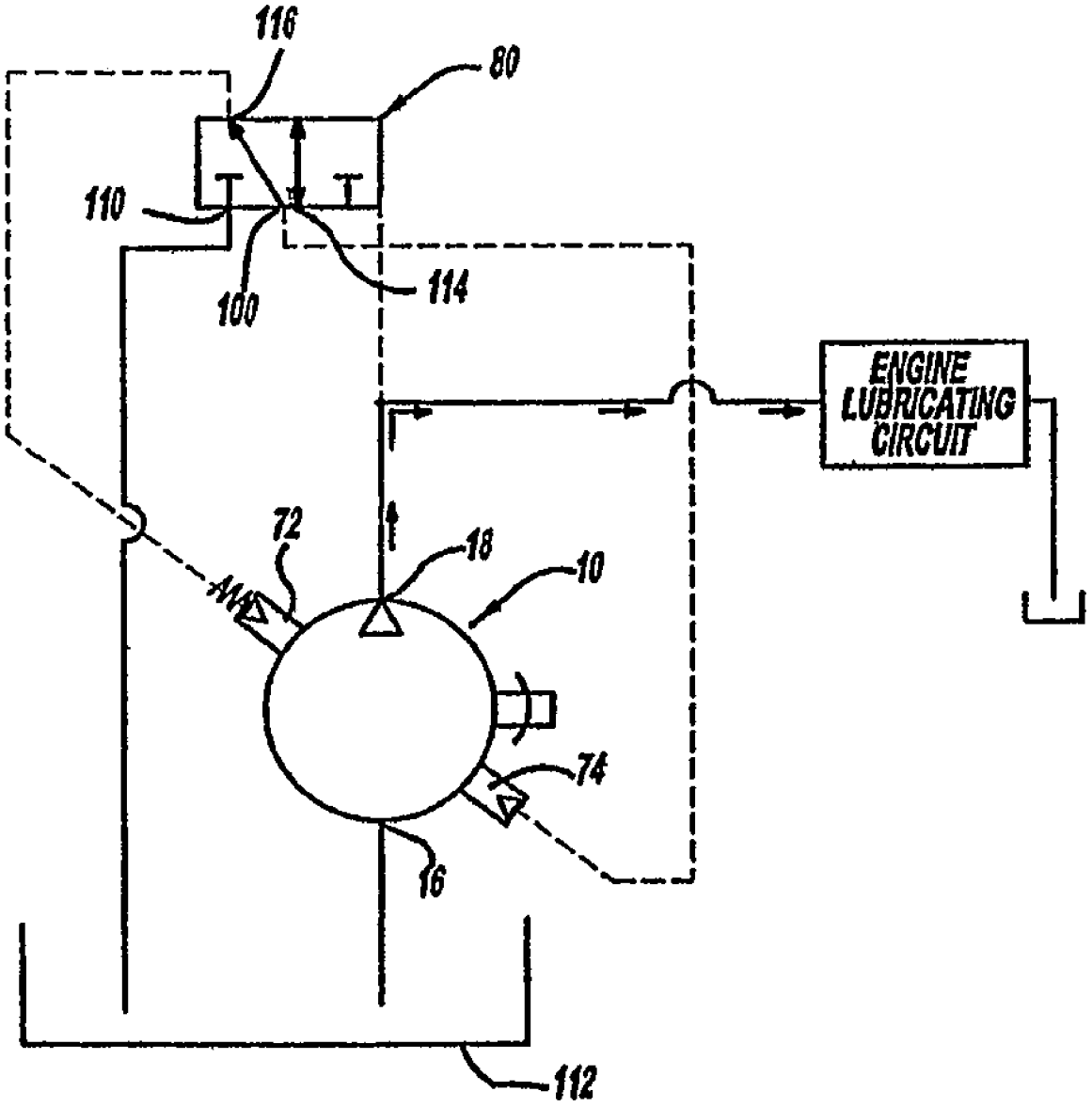
Figure 9:
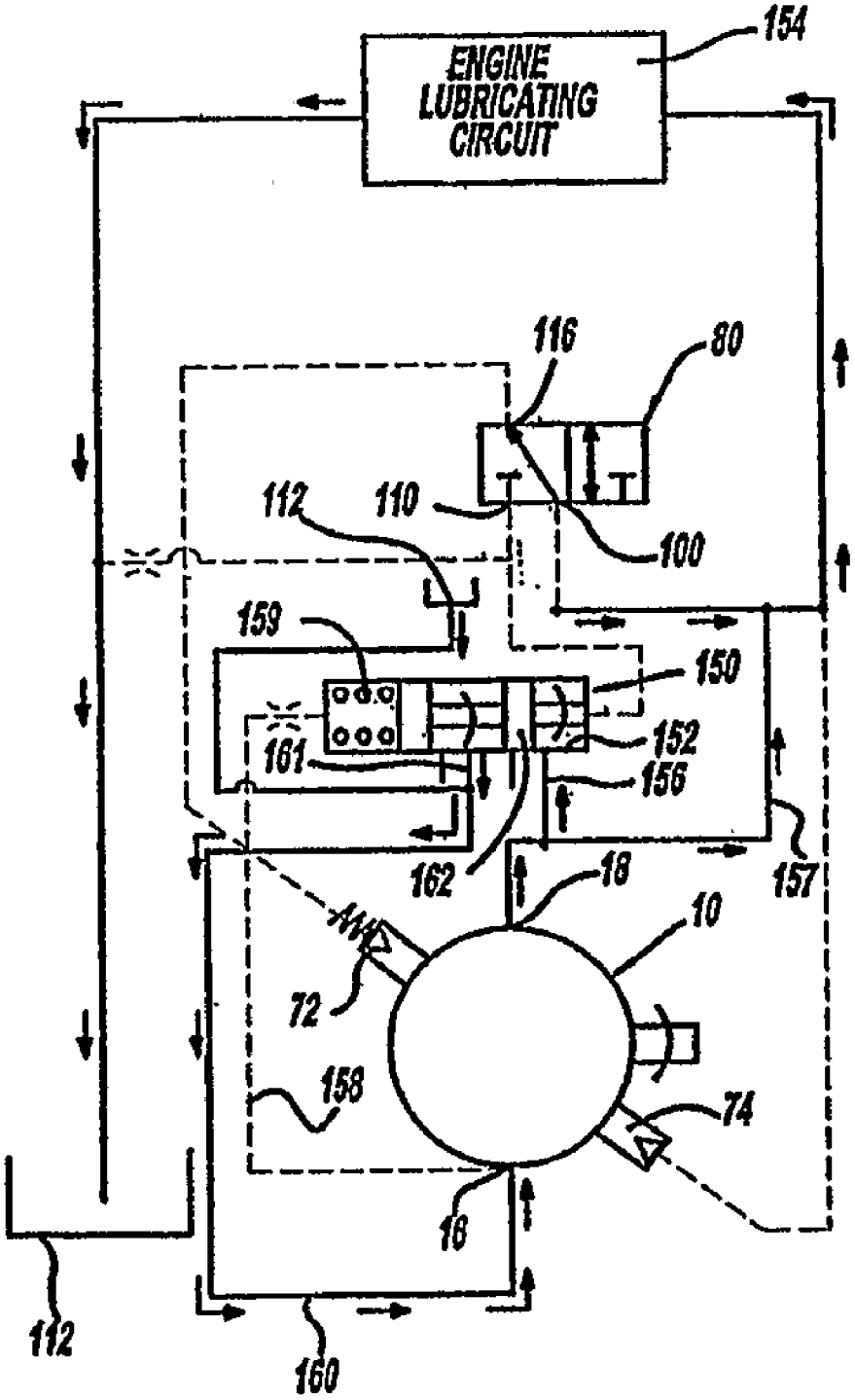
Figure 10:
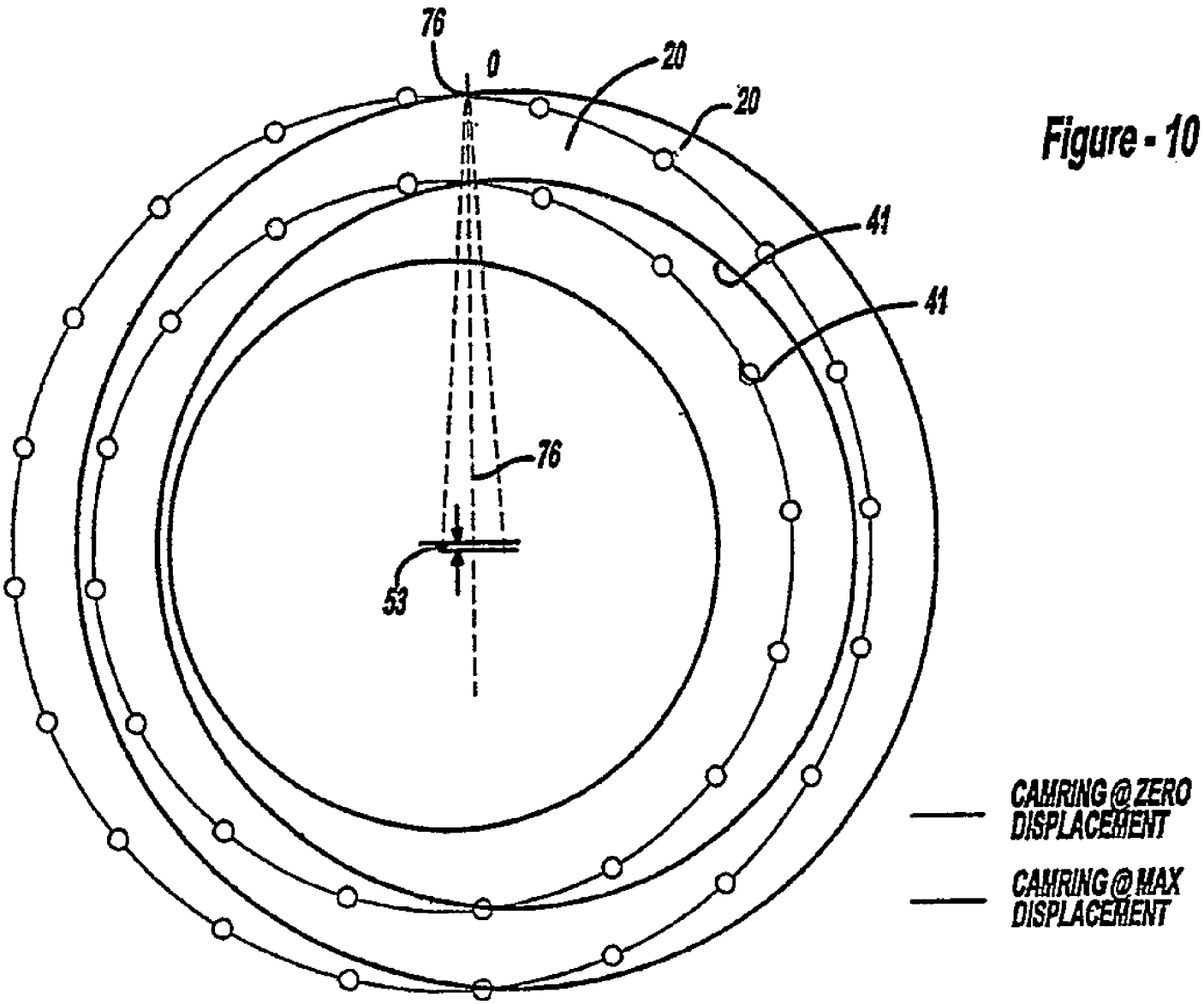

The containment ring or eccentric ring 20 is annular having an opening 41 and is received within the chamber 26 of the housing 22. The containment ring or eccentric ring 20 has a groove 42 in its exterior surface which receives in part the pivot pin 36 to permit pivotal movement between the containment ring or eccentric ring 20 and central body 24. Such pivotal movement of the containment ring or eccentric ring 20 is limited by engagement of the exterior surface of the containment ring or eccentric ring 20 with the interior surface 34 of the central body 24. As viewed in FIGS. 4 and 10, the containment ring or eccentric ring 20 is pivoted counterclockwise into engagement with the housing 22 in its first position wherein the pump 10 has its maximum displacement. As best shown in FIGS. 3 and 10, the containment ring or eccentric ring 20 may be pivoted clockwise from its first position to a second position in which the pump 10 has its minimum displacement. Of course, the containment ring or eccentric ring 20 may be operated in any orientation between and including its first and second positions to vary the displacement of the pump, as desired. The containment ring or eccentric ring 20 has an internal surface which is generally circular, but may be contoured or off-centered to improve or alter the pump 10 performance. The containment ring or eccentric ring 20 may also have a second groove 44 in its exterior surface adapted to carry the seal 40 engageable with the internal surface 34 of the central body 24 to provide a fluid tight seal between the containment ring or eccentric ring 20 and central body 24. The fluid tight seal essentially separates the chamber 26 into two portions 26*a*, 26*b* on either side of the seal to enable a pressure differential to be generated between the separated chamber portions 26*a*, 26*b*. The pressure differential may be used to pivot the containment ring or eccentric ring 20 between or to its first and second positions to control the pump displacement.

To move fluid through the pump 10, a rotating displacement group 50 is provided in the housing 22. The rotating displacement group 50 comprises a central drive shaft 52, the rotor 12 which is carried and driven for rotation by the drive shaft 52, and a plurality of vanes 14 slidably carried by the rotor 12 for co-rotation with the rotor 12. The drive shaft 52 is fixed in position for rotation about its own axis 53. The rotor 12 is fixed to the drive shaft 52 for co-rotation therewith about the axis of the shaft 52.

As shown, the rotor 12 is a generally cylindrical member having a plurality of circumferentially spaced apart and axially and radially extending slots 54 that are open to an exterior surface 56 of the rotor 12 and which terminate inwardly of the exterior surface 56. Each slot 54 is constructed to slidably receive a separate vane 14 so that the vanes are movable relative to the rotor 12 between retracted and extended positions. Each slot 54 in the rotor 12 preferably terminates at a small chamber 58 constructed to receive pressurized fluid. The pressurized fluid in a chamber 58 acts on the vane 14 in the associated slot 54 to cause the vane 14 to slide radially outwardly until it engages the internal surface 34 of the containment ring or eccentric ring 20. Preferably, during operation of the pump 10, the fluid pressure within the chamber 58 and slot 54 is sufficient to maintain substantially continuous contact between the vanes 14 and the internal surface of the containment ring or eccentric ring 20.

In accordance with one aspect of the present invention, a vane extension member 60 is movably positioned on the rotor 12 to engage one or more of the vanes 14 and cause such vanes 14 to extend radially outwardly beyond the periphery of the rotor 12. This facilitates priming the pump 10 by ensuring that at least two of the vanes 14 extend beyond the periphery of the rotor 12 at all times. Without the extension member 60 the vanes 14 may tend to remain in their retracted position, not extending beyond the exterior 56 of the rotor 12, such that subsequent turning of the rotor 12 without any vanes 14 extending outwardly therefrom, does not displace sufficient fluid to prime the pump 10 and increase the pump output pressure. Accordingly, no fluid pressure is generated in the chambers 58 or slots 54 of the rotor 12 and therefore no pressure acts on the vanes 14 causing them to extend outwardly and the pump 10 will not prime. Such a condition may be encountered, for example, in mobile and automotive applications when starting a cold vehicle in cold weather such as during a cold start of an automobile.

In the embodiment shown in FIG. 2, the vane extension member 60 is a ring slidably received in an annular recess 62 formed in an end face of the rotor 12 and having a diameter sufficient to ensure that at least two of the vanes 14 extends beyond the periphery of the rotor 12 at all times. The recess 62 provides an outer shoulder 64 and an inner shoulder 66 between which the ring 60 may slide. The ring 60 slides in the recess 62 when acted on by vanes 14 which are radially inwardly displaced via engagement with the containment ring or eccentric ring 20 thereby pushing the ring 60 towards the diametrically opposed vanes 14 causing them to extend beyond the periphery of the rotor 12. The ring 60 is retained between the rotor 12 and the adjacent side plate of the housing 22 in assembly of the pump 10. A second ring may be provided on the opposite face of the rotor, if desired.

Figure 6:
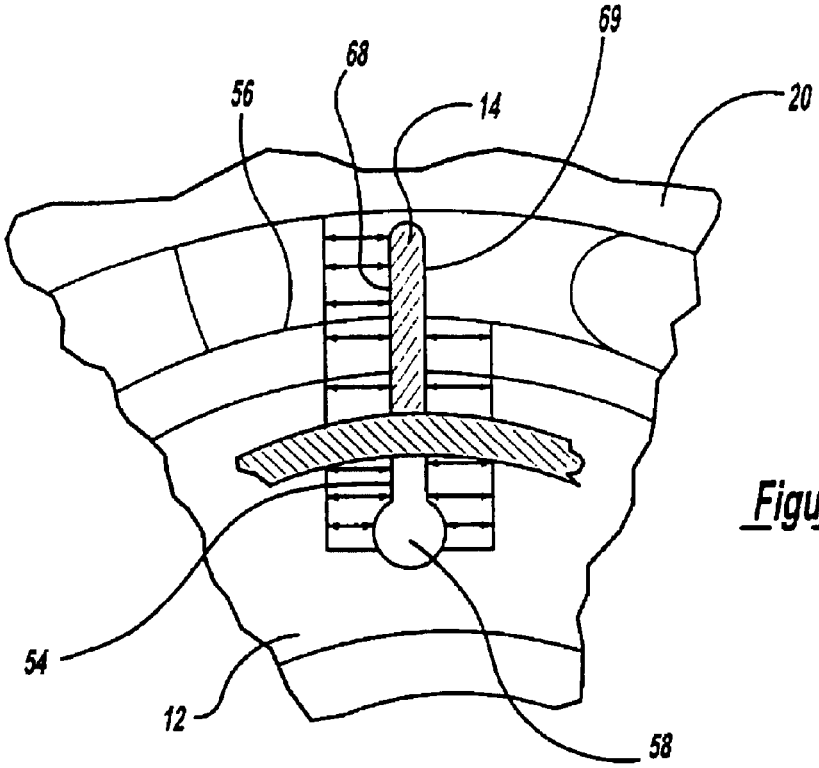
FIG. 6 is an enlarged, fragmentary sectional view illustrating a portion of the rotor and a vane according to the present invention.
Figure 7:
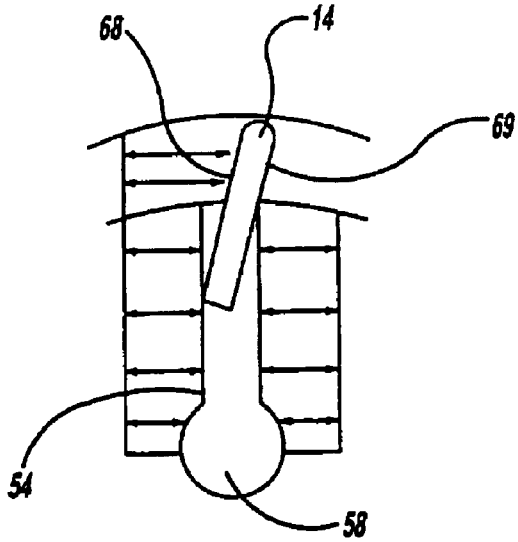
FIG. 7 is an enlarged, fragmentary sectional view of the rotor and vane illustrating a seal between the vane and rotor when the vane is tilted within its slot in the rotor.

Desirably, as shown in FIGS. 6 and 7, the slots 54 in the rotor 12 are sized to permit a fluid film to form on the leading and trailing faces 68, 69 of each vane 14. The fluid film supports the vanes 14 as the rotor 12 rotates. The fluid film prevents a wear of the fluid slot effectively seating a bearing surface. Additionally, the size of the slots 54 is desired to prevent vane tilt while still slowing fluid to enter a contact seal between the rotor 12 and vanes 14 in the areas of their contact should vane tilting occur, to the extent that any vane tilting is present. The contact seals maintain the pressurized fluid acting on the vanes 14 and prevents it from leaking or flowing out of the slots 54. Such leakage is otherwise likely to occur due to the pressure differential between the fluid in the chambers 58 and slots 54 which is at pump outlet pressure and lower pressure portions of the pump cycle (nearly all but at the outlet of the pump). By preventing this leakage, it is ensured that a sufficient hydrostatic force biases the vanes 14 radially outwardly toward the containment ring or eccentric ring 20 to improve the continuity of the contact between the vanes 14 and the containment ring or eccentric ring 20.

To displace fluid, the containment ring or eccentric ring 20 is mounted eccentrically relative to the drive shaft 52 and rotor 12. This eccentricity creates a varying clearance or gap between the containment ring or eccentric ring 20 and the rotor 12. The varying clearing creates fluid pumping chambers 70, between adjacent vanes 14, the rotor 12 and the internal surface of the containment ring or eccentric ring 20, which have a variable volume as they are rotated in use. Specifically, each pumping chamber 70 increases in volume during a portion of its rotational movement, thereby creating a drop in pressure in that pumping chamber 70 tending to draw fluid therein. After reaching a maximum volume, each pumping chamber 70 then begins to decrease in volume increasing the pressure therein until the pumping chamber is registered with an outlet and fluid is forced through said outlet at the discharge pressure of the pump 10. Thus, the eccentricity provides enlarging and decreasing pumping chambers 70 which provide both a decreased pressure to draw fluid in through the inlet of the pump 10 and thereafter increase the pressure of the fluid and discharge it from the outlet of the pump 10 under pressure.

The degree of the eccentricity determines the operational characteristics of the pump 10, with more eccentricity providing higher flow rate of the fluid through the pump 10 and less eccentricity providing a lower flow rate in pressure of the fluid. In a so-called "zero displacement position" or the second position of the containment ring or eccentric ring 20 shown in FIG. 3, the opening 41 is essentially coaxially aligned with the rotor 12 so that the fluid pumping chambers 70 have an essentially constant volume throughout their rotation. In this orientation, the pumping chambers 70 do not enlarge to draw flow therein nor do they become smaller in volume to increase the pressure of fluid therein creating a minimum performance condition or a zero displacement condition of the pump 10. When the containment ring or eccentric ring 20 is in its first or maximum displacement position the pumping chambers 70 vary in size between their maximum volume and minimum volume as the rotor 12 rotates providing increased pump displacement.

Figure 4:
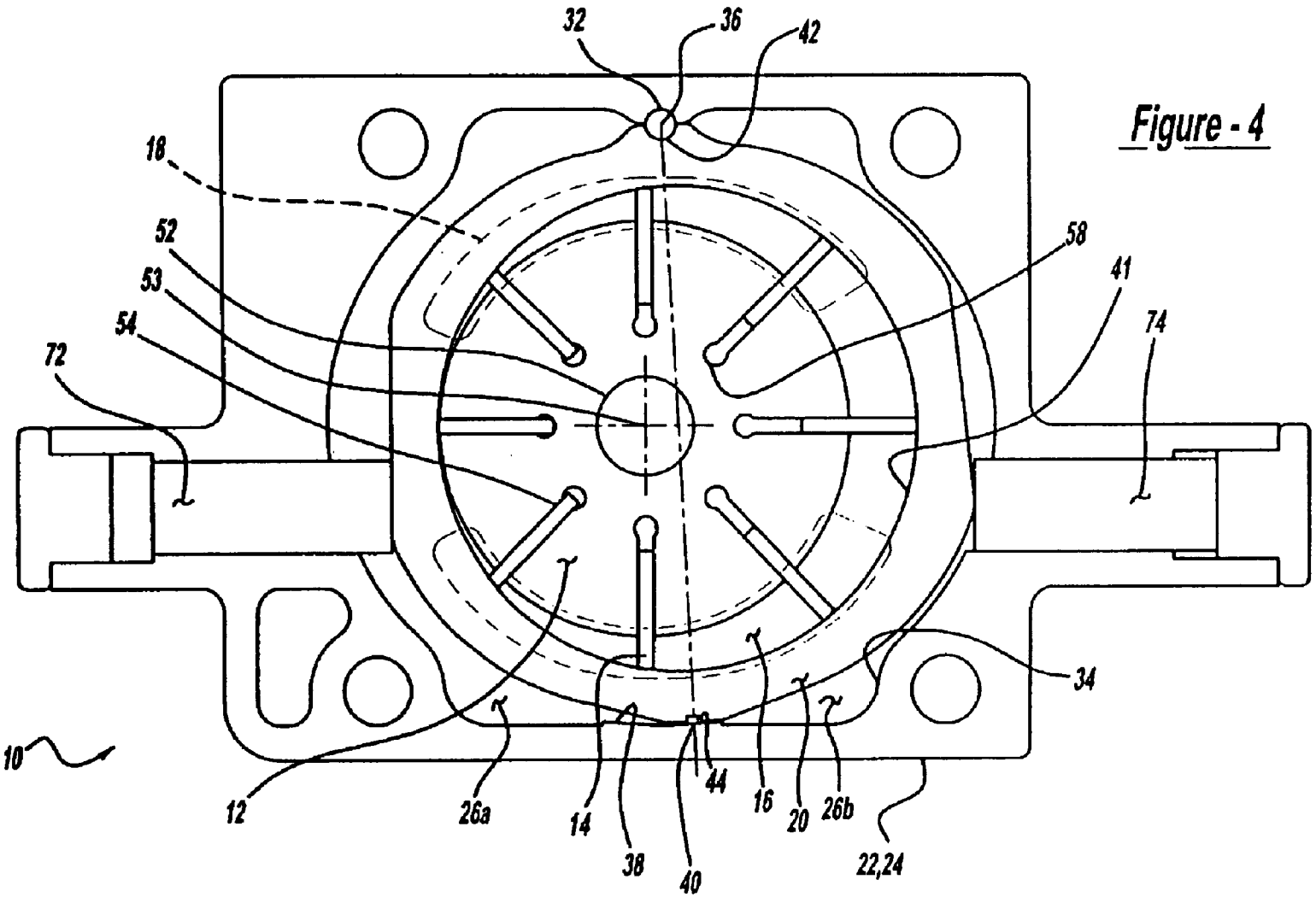
FIG. 4 is a plan view of the pump as in FIG. 2 illustrating the containment ring or eccentric ring in its maximum-displacement position.

As shown in FIGS. 3 and 4, to control the pivoting and location of the containment ring or eccentric ring 20 a pair of pistons 72, 74 may be utilized with the pistons 72, 74 operable in opposed directions to pivot the containment ring or eccentric ring 20 between its first and second positions. Desirably, each piston 72, 74 may be responsive to different fluid pressure signals that may be taken from two different points in the fluid circuit, one of which must come from the regulating valve. Accordingly, two different portions of the fluid circuit may be used to control the displacement of the containment ring or eccentric ring 20, and hence the operation and displacement of the pump 10. The pistons 72, 74 may be of different sizes as desired to vary the force on the pistons from the pressurized fluid signals. Further, one or both of the pistons 72, 74 may be a spool type valve biased by a spring, or other mechanism to aid in controlling the movement of the containment ring or eccentric ring 20 and operation of the pump. As an alternative, if a seal 40 is provided between the containment ring or eccentric ring 20 and housing 22, a controlled volume of fluid under pressure may be disposed directly in the chamber portions 26*a*, 26*b* defined on opposite sides of the seal 40. Fluid at different volumes and pressures may be provided on either side of the seal 40 to control the movement of the containment ring or eccentric ring 20. Of course, any combination of these actuators may be used to control the movement and position of the containment ring or eccentric ring 20 in use of the pump 10.

Desirably, as best shown in FIG. 10, in accordance with a further aspect of the present invention, the axis 76 about which the containment ring or eccentric ring 20 is pivoted is located to provide an essentially linear movement of the containment ring or eccentric ring 20 between its first and second positions. To do so, the containment ring or eccentric ring 20 is pivoted about an axis 76 which is offset from the drive shaft axis 53 by one-half of the distance of travel in the direction of eccentricity of the containment ring or eccentric ring 20 between its first and second positions. In other words, the pivot axis 76 of the containment ring or eccentric ring 20 is offset from the drive shaft axis 53 by one-half of the maximum eccentricity of the containment ring or eccentric ring 20 relative to the drive shaft axis 53, and hence, relative to the rotor 12. The pivoting movement of the containment ring or eccentric ring 20 occurs along an at least somewhat arcuate path. By positioning the pivot axis 76 of the containment ring or eccentric ring 20 as described, the path of movement of the containment ring or eccentric ring 20 becomes essentially linear between its first and second positions. Non-linear or compound movement of the containment ring or eccentric ring 20 affects the gap or clearance between the rotor 12 and the containment ring or eccentric ring 20. The performance and operating characteristics of the pump 10 are influenced by this gap or clearance. Accordingly, the non-linear movement of the containment ring or eccentric ring 20 when it is pivoted can vary the size of the fluid chambers throughout the pump 10, and importantly, in the area of the inlet 16 and outlet 18 of the pump. For example, the pumping chambers 70 may become slightly larger in volume as they approach the outlet 18 reducing the pressure of fluid therein and causing inefficient pressurization of the fluid at the discharge port. Desirably, offsetting the pivot axis 76 of the containment ring or eccentric ring 20 in accordance with this invention provides a movement of the containment ring or eccentric ring 20 which reduces such centrality errors and facilitates control of the pump operating characteristics to improve pump performance and efficiency. The arrangement of the invention also permits a more simple pump design with a center point of the containment ring or eccentric ring opening 41 moving along an essentially linear path. Further, the pump 10 should operate with less airborne or fluid borne noise.

Figure 5:
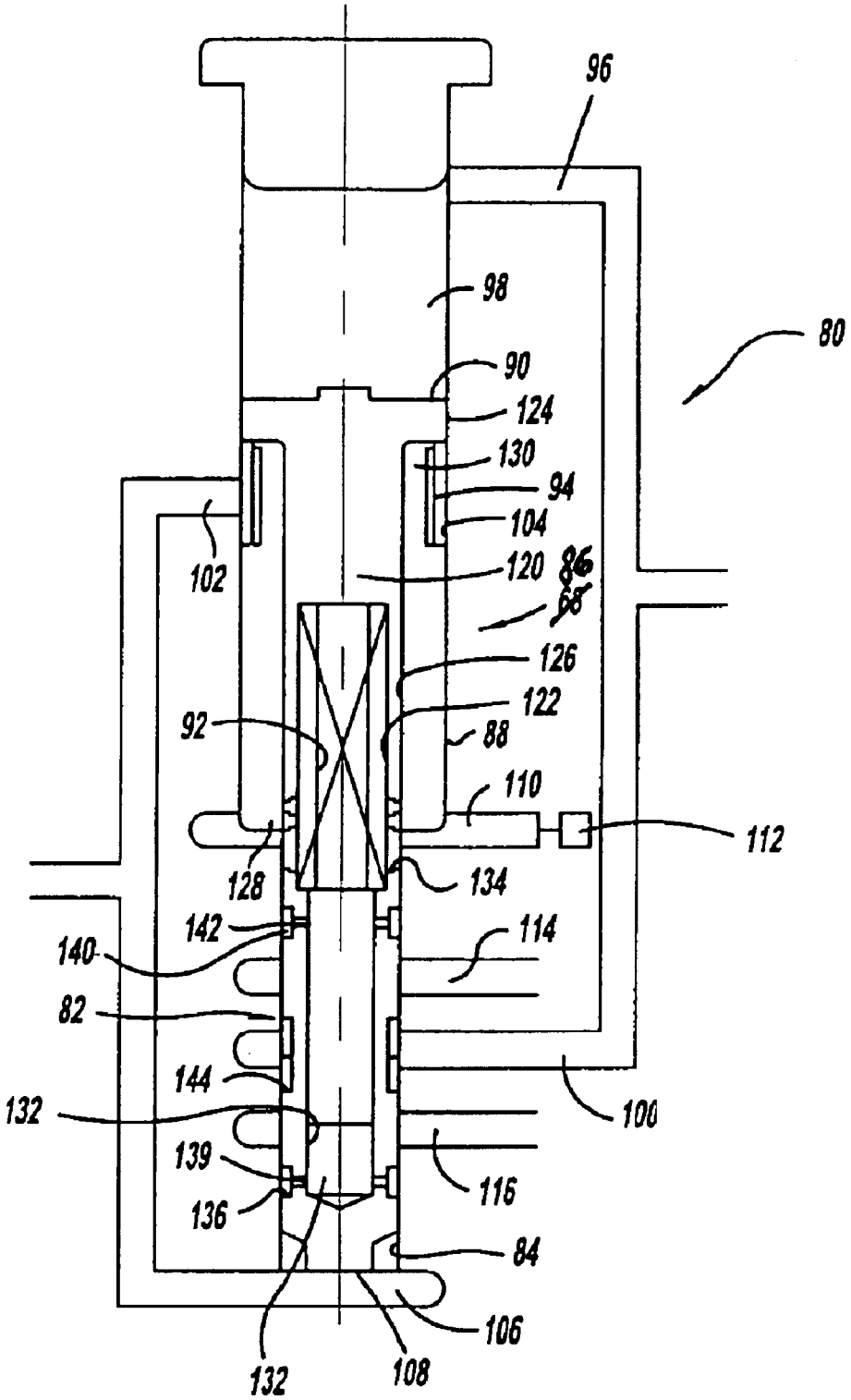
FIG. 5 is a diagrammatic sectional view of a variable target dual pilot regulation valve which pivots the containment ring or eccentric ring of the pump according to one aspect of the present invention.

Preferably, to control the application of fluid pressure signals to the actuators that in turn control the movement of the containment ring or eccentric ring 20, a single control valve 80 reacts to two pilot pressure signals and their application to the actuators. As shown in FIG. 5, the control valve 80 has a spool portion 82 with a plurality of annular grooves and lands between adjacent grooves providing sealing engagement with a bore 84 in which the spool portion 82 is received. The valve 80 also has a piston portion 86 comprising an outer sleeve 88 and an inner piston 90 slidably carried by the sleeve 88. A first spring 92 is disposed between the plunger 90 and the spool portion 82 to yieldably bias the position of the spool portion 82 and a second spring 94 is disposed between the sleeve 88 and the plunger 90 to yieldably bias the plunger 90 away from the sleeve 88.

Figure 8:
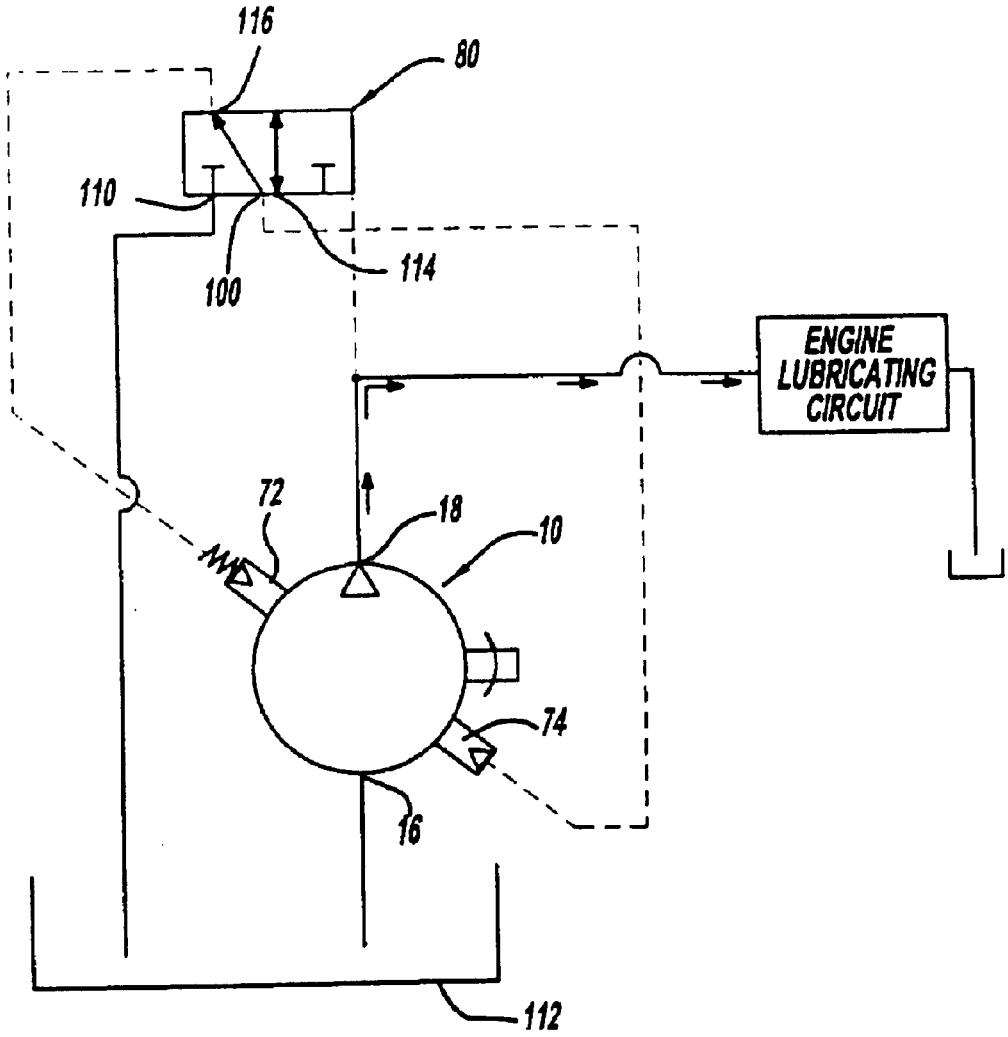
FIG. 8 is a schematic representation of the hydraulic circuit of the vane pump of an embodiment of this invention including completing a 3-way variable target dual pilot regulation valve.

As shown in FIGS. 5 and 8, the valve 80 has a first inlet 96 through which fluid discharged from the pump 10 is communicated with a chamber 98 in which the plunger 90 is received to provide a force acting on the plunger 90 in a direction opposing the biasing force of the second spring 94. A second inlet 100 communicates fluid discharged from the pump 10 with the spool portion 82. A third inlet 102 communicates fluid pressure from a downstream fluid circuit source from a second portion of the fluid circuit with a chamber 104 defined between the plunger 90 and outer sleeve 88. A fourth inlet 106 communicates the second portion of the fluid circuit with an end 108 of the spool portion 82 located opposite the plunger 90. In addition to the inlets, the valve 80 has a first outlet 110 communicating with a sump or reservoir 112, a second outlet 114 communicating with the first actuator 74, and a third outlet 116 communicating with the second actuator 72. As discussed above, the first and second actuators 72, 74 control movement of the containment ring or eccentric ring 20 to vary the displacement of the pump 10.

In more detail, the plunger 90 has a cylindrical body 120 with a blind bore 122 therein to receive and retain one end of the first spring 92. An enlarged head 124 at one end of the plunger 90 is closely slidably received in the chamber 98, which may be formed in, for example, the pump housing 22, and is constructed to engage the outer sleeve 88 to limit movement of the plunger 90 in that direction. The outer sleeve 88 is preferably press-fit or otherwise fixed against movement in the chamber 98. The outer sleeve 88 has a bore 126 which slidably receives the body 120 of the plunger 90, a radially inwardly extending rim 128 at one end to limit movement of the spool portion 82 toward the plunger 90, and a reduced diameter opposite end 130 defining the annular chamber 104 in which the second spring 94 is received. The annular chamber 104 may also receive fluid under pressure which acts on the plunger 90.

The spool portion 82 is generally cylindrical and is received in the bore 84 of a body, such as the pump housing 22. The spool portion 82 has a blind bore 132, is open at one end 134 and is closed at its other end 108. A first recess 136 in the exterior of the spool portion 82 leads to one or more passages 139 which open into the blind bore 132. The first recess 136 is selectively aligned with the third outlet 116 to permit the controlled volume of pressurized fluid, keeping the displacement high at the second actuator 72 (chamber 26*a*) to vent back through the spool portion 82 via the first recess 136, corresponding passages 139 blind bore 132 and the first outlet 110 leading to the sump or reservoir 112. This reduces the volume and pressure of fluid at the second actuator 72 (chamber 26*a*). Likewise, the spool portion 82 has a second recess 140 which leads to corresponding passages 142 opening into the blind bore 132 and which is selectively alignable with the second outlet 114 to permit fluid controlled volume of pressurized fluid, keeping the displacement low at the first actuator 74 (chamber 26*b*) to vent back through the valve 80 via the second recess 140, corresponding passages 142, blind bore 132 and first outlet 110 to the sump or reservoir 112.

The spool portion 82 also has a third recess 144 disposed between the first and second recesses 136, 140 and generally aligned with the second inlet 100. The third recess 144 has an axial length greater than the distance between the second inlet 100 and the second outlet 114 and greater than the distance between the second inlet 100 and the third outlet 116. Accordingly, when the spool portion 82 is sufficiently displaced toward the plunger portion 86, the third recess 144 communicates the second outlet 114 with the second inlet 100 to enable fluid at discharge pressure to flow through the second outlet 114 from the second inlet 100. This increases the volume and pressure of fluid acting on the first actuator 74. Likewise, when the spool portion 82 is displaced sufficiently away from the plunger portion 86, the third recess 144 communicates the second inlet 100 with the third outlet 116 to permit fluid at pump discharge pressure to flow through the third outlet 116 from the second inlet 100. This increases volume and pressure of fluid acting on the second actuator 72. From the above it can be seen that displacement of the spool portion 82 controls venting of the displacement control chamber through the first and second recesses 136, 140, respectively, when they are aligned with the second and third outlets 114, 116, respectively. Displacement of the spool portion 82 also permits charging or increasing of the pilot pressure signals through the third recess 144 when it is aligned with the second and third outlets 114, 116, respectively.

Desirably, the displacement of the spool portion 82 may be controlled at least in part by two separate fluid signals from two separate portions of the fluid circuit. As shown, fluid at pump discharge pressure is provided to chamber 98 so that it is applied to the head 124 of the plunger 90 and tends to displace the plunger 90 toward the spool portion 82. This provides a force (transmitted through the first spring 92) tending to displace the spool portion 82. This force is countered, at least in part, by the second spring 94 and the fluid pressure signal from a second point in the fluid circuit which is applied to the distal end 108 of the spool portion 82 and to the chamber 104 between the outer sleeve 88 and plunger 90 which acts on the head 124 of the plunger 90 in a direction tending to separate the plunger from the outer sleeve. The movement of the spool portion 82 can be controlled as desired by choosing appropriate springs 92, 94, fluid pressure signals and/or relative surface areas of the plunger head 124 and spool portion end 108 upon which the pressure signals act. Desirably, to facilitate calibration of the valve 80, the second spring 94 may be selected to control the initial or at rest compression of the first spring 92 to control the force it applies to the spool portion 82 and plunger 90.

In response to these various forces provided by the springs 92, 94 and the fluid pressure signals acting on the plunger 90 and the spool portion 82, the spool portion 82 is moved to register desired recesses with desired inlet or outlet ports to control the flow of fluid to and from the first and second actuators 72, 74 (or chamber 26*a*/26*b*). More specifically, as viewed in FIG. 5, when the spool portion 82 is driven downwardly, the third recess 144 bridges the gap between the second inlet 100 and the third outlet 116 so that pressurized fluid discharged from the pump 10 is provided to the second actuator 72. This movement of the spool portion 82 preferably also aligns the second recess 140 with the second outlet 114 to vent the volume and pressure of fluid at the first actuator 74 to the sump or reservoir 112. Accordingly, the containment ring or eccentric ring 20 will be displaced by the second actuator 72 toward its first position increasing the displacement of the pump 10. The spool 82 operates with the bore 84 and outlets to behave as what is commonly known as a "4-way directional valve." As the spool portion 82 is driven upwardly, as viewed in FIG. 5, the third recess 144 will bridge the gap between the second inlet 100 and the second outlet 114 providing fluid at pump discharge pressure to the first actuator 74. This movement of the spool portion 82 preferably also aligns the first recess 136 with the third outlet 116 to vent the volume of and pressure of fluid at the second actuator 72 to the sump or reservoir 112. Accordingly, the containment ring or eccentric ring 20 will be moved toward its second position decreasing the displacement of the pump 10. In this manner, the relative controlled volume and pressures are controlled by two separate pressure signals which may be taken from two different portions of the fluid circuit. In the embodiment shown, a first pressure signal is the fluid discharged from the pump 10 and a second pressure signal is from a downstream fluid circuit source. In this manner, the efficiency and performance of the pump can be improved through more capable control.

Figure 9:
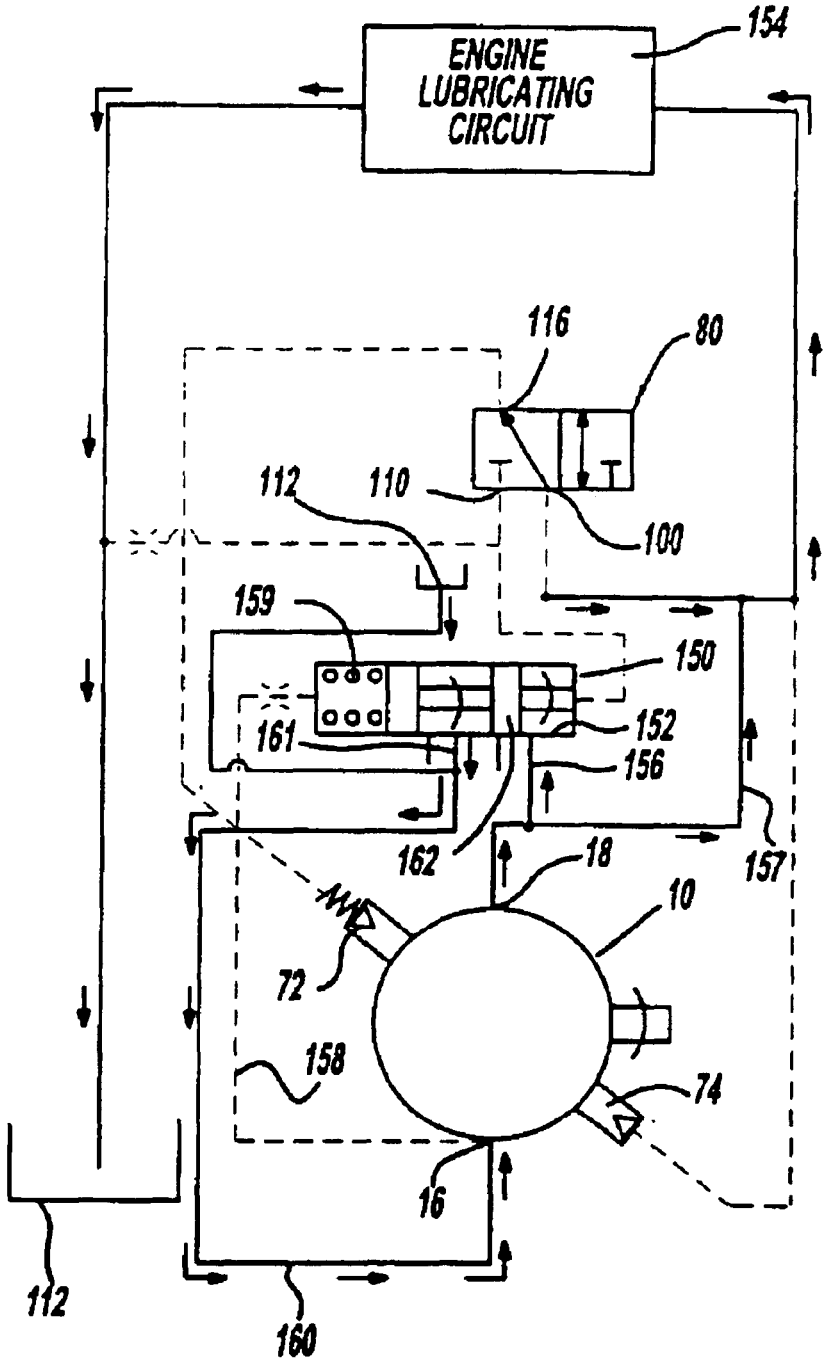
FIG. 9 is a schematic representation of the hydraulic circuit of a vane pump according to the present invention including a 3-way regulation valve and an anti-cavitation valve.

As best shown in FIG. 9, an inlet flow valve 150 in the fluid circuit may be provided to selectively permit fluid at pump discharge pressure to flow back into the pump inlet 16 when the pump 10 is operating at speeds wherein atmospheric pressure is insufficient to fill the inlet port 16 of the pump 10 with fluid. This reduces cavitation and overcomes any restriction of fluid flow to the inlet 16 of the pump 10 or any lack of fluid potential energy. To accomplish this, the inlet flow valve 150 may be a spool type valve slidably received in a bore 152 of a body, such as the pump housing 22, so that it is in communication with the fluid discharged from the pump outlet 18. As shown, the fluid circuit comprises the pump 10, with the pump outlet 18 leading to an engine lubrication circuit 154 through a supply passage 156 which is connected to the bore 152 containing the inlet flow valve 150. Downstream of the engine lubrication circuit 154, fluid is returned to a reservoir 112 with a portion of such fluid routed through a pilot fluid passage 158 leading to the inlet flow valve 150 to provide a pilot pressure signal on the inlet flow valve 150, if desired. A spring 159 may also be provided to bias the inlet flow valve 150. From the reservoir, fluid is supplied through an inlet passage 160 to the inlet 16 of the fuel pump 10. The inlet passage 160 can pass through the bore 152 containing the inlet flow valve 150 and is separated from the supply passage 156 by a land 162 of the inlet flow valve 150 which provides an essentially fluid tight seal with the body.

Accordingly, the fluid discharged from the pump 10 acts on the land 162 by way of passage 156 in communication with from outlet line 157 and tends to displace the inlet flow valve 150 in a direction opposed by the spring 159 and the pilot pressure signal applied to the inlet flow valve 150 through the pilot fluid passage 158. When the pressure of fluid discharged from the pump 10 is high enough, to overcome the spring and pilot pressure from passage 158, the inlet flow valve 150 will be displaced so that its land 162 will be moved far enough to open the inlet passage 160 permitting communication between the supply passage 156 and inlet passage 160 through the bore 152 and passage 161, as shown in FIG. 9. Thus, a portion of the fluid discharged from the pump 10 is fed back into the inlet 16 of the pump 10 along with fluid supplied from the reservoir 112 for the reasons stated above. This aspirated flow of pressurized fluid into the inlet 16 supercharges the pump inlet to ensure that the pump 10 is pumping liquid and not air or gas. This prevents cavitation and improves the pump efficiency and performance.

The purpose of the valve 150 and its supercharging effect is to convert available pressure energy into velocity energy at the inlet to provide supercharging.

Accordingly, the pump 10 incorporates many features which facilitate the design and operation of the pump, enable vastly improved control over the pump operating parameters and output, and improve overall pump performance and efficiency. Desirably, the vane pump of the invention can meet the various requirements of lubrication for internal combustion engines at all speeds. Of course, the vane pump may also be utilized in power transmission and other fluid distribution applications.

Finally, while preferred embodiments of the invention have been described in some detail herein, the scope of the invention is defined by the claims which follow. Modifications of and applications for the inventive pump which are entirely within the spirit and scope of the invention will be readily apparent to those skilled in the art.

What is claimed is:

1. A variable displacement vane pump, comprising:

a housing defining a chamber, a pump inlet through which fluid enters the housing and a pump outlet through which fluid is discharged from the housing under pressure;

a containment ring or eccentric ring pivotally carried by the housing for movement between a first position and a second position and defining an opening with an internal surface;

a rotor carried by the housing for rotation relative to the internal surface and having a plurality of slots extending inwardly into the rotor from an exterior of the rotor;

a plurality of vanes carried by the rotor with each vane slidably received in a slot in the rotor;

a first actuator responsive to application of fluid under pressure and operable to pivot the containment ring or eccentric ring in a first direction;

a second actuator responsive to application of fluid under pressure and operable to pivot the containment ring or eccentric ring in a second direction;

wherein control and positioning of the first and second actuators are a function of a combination of a first pressure signal and a second pressure signal taken from discrete locations separated by a degree of inherent hydraulic resistance in a downstream fluid circuit;

an area defining a fluid chamber formed between the housing and containment ring or eccentric ring with fluid under pressure in the fluid chamber defining the first actuator; and a control valve responsive to the differential between the first pressure signal and the second pressure signal to selectively apply, based on engine conditions, application of fluid under pressure to either the first or second actuator based on engine conditions.

2. The pump of claim 1 wherein the first actuator is a piston slidably carried by the housing.

3. The variable displacement vane pump of claim 1 wherein said second direction is in a direction opposite of the first direction.

4. The pump of claim 1 wherein the second actuator is a piston slidably carried by the housing.

5. The pump of claim 1 wherein the first actuator includes a spring that in yielding biases the containment ring or eccentric ring in the first direction.

6. The pump of claim 1 which also comprises a seal between the containment ring or eccentric ring and the housing.

7. The pump of claim 1 which also comprises another fluid chamber defined at least in part by seal with fluid under pressure in the another fluid chamber defining the second actuator.

8. The pump of claim 1 which also comprises a pivot pin about which the containment ring or eccentric ring pivots, the pivot pin defining a pivot axis of the containment ring or eccentric ring which is offset from the axis of the rotor by about one-half the maximum eccentricity of the containment ring or eccentric ring relative to the rotor.

9. The pump of claim 1 which also comprises an inlet flow valve responsive to a fluid pressure signal above a threshold pressure to permit a portion of fluid discharged from the pump outlet to flow into the pump inlet during at least some fluid flow conditions.

10. The pump of claim 9 wherein the inlet flow valve is yieldably biased to a position preventing fluid discharged from the pump outlet to flow into the inlet of the pump and is displaced by a sufficiently high fluid pressure signal to a position permitting fluid discharged from the pump outlet to flow into the pump inlet.

11. The pump of claim 1 which also comprises a vane extension member carried by the housing and engageable with the vanes during at least certain positions of the rotor to ensure that at least two vanes extend outwardly from the exterior of the rotor at all times.

12. The pump of claim 11 wherein the vane extension member is a ring carried by the rotor to engage at least two vanes at all times.

13. The pump of claim 1 wherein the slots on the rotor extend radially inwardly of the rotor.

14. The pump of claim 1 wherein the seal is defined by direct contact between the containment ring or eccentric ring and the housing.

15. The pump of claim 1 wherein the seal is carried by the containment ring or eccentric ring.

16. The pump of claim 1 wherein the seal is carried on the housing.

17. The pump of claim 10 wherein fluid under pressure is communicated with the slots in the rotor to bias the vanes into contact with the cam surface.

18. The pump of claim 11 wherein the vane extension member further comprises a ring portion for engaging the two vanes and oil pressure acting on the vanes for extending the vanes outwardly.

19. The pump of claim 1 which also comprises an exhaust opening in the housing through which fluid in the fluid chamber is discharged under certain fluid flow conditions and wherein the control valve controls fluid flow from the fluid chamber through the exhaust opening in response to certain fluid pressures of said first and second pilot pressures.

20. The pump of claim 1 wherein the vanes have leading and trailing faces and the slots in the rotor are slightly wider than the vanes received in said slots so that a fluid film forms between the rotor and the leading and trailing faces of each vane.

21. The pump of claim 20 further comprises a seal between a vane and the rotor to restrict fluid flow between them.

22. The pump of claim 21 wherein the seal is formed by contact between the vane and rotor.

23. The pump of claim 10 wherein the inlet flow valve is biased by a spring.

24. The pump of claim 23 wherein the inlet flow valve is further biased by a pilot pressure signal.

25. A variable displacement vane-type fluid pump, comprising:

a housing defining a pump inlet through which fluid enters the pump, a pump outlet from which fluid is discharged under pressure and a fluid chamber between the pump inlet and pump outlet;

a containment ring or eccentric ring pivotally carried by the housing within the fluid chamber for movement between a first position and a second position, the containment ring or eccentric ring having an interior opening with an internal surface;

a rotor carried by the housing at least in part in the interior opening of the containment ring or eccentric ring, driven for rotation relative to the internal surface and having a plurality of slots extending radially inwardly into the rotor from an exterior of the rotor;

a plurality of vanes carried by the rotor with a vane slidably received in each slot in the rotor;

a first actuator responsive to a first fluid pressure and operable to pivot the containment ring or eccentric ring toward its first position;

a second actuator responsive to a second fluid pressure and operable to pivot the containment ring or eccentric ring toward its second position;

a control valve responsive to the differential between a first pressure signal and a second pressure signal to selectively apply, based on engine conditions, application of fluid under pressure to either the first or second actuator based on engine conditions;

wherein control and positioning of the first and second actuators are a function of a combination of the first pressure signal and the second pressure signal taken from discrete locations separated by a degree of inherent hydraulic resistance in a downstream fluid; and an area defining fluid chamber form d between the housing and containment ring or eccentric ring with fluid under pressure in the fluid chamber defining the first actuator.

26. A variable displacement vane-type fluid pump, comprising:

a housing defining a pump inlet through which fluid enters the pump, a pump outlet from which fluid is discharged under pressure and a fluid chamber between the pump inlet and pump outlet;

a containment ring or eccentric ring pivotally carried by the housing for movement between a first position and a second position and defining an internal surface;

a rotor carried by the housing in the fluid chamber for rotation relative to the internal surface and having a plurality of slots extending inwardly into the rotor from an exterior of the rotor;

a plurality of vanes carried by the rotor with a vane slidably received in each slot in the rotor;

a first actuator responsive to a first control pressure and operable to pivot the containment ring or eccentric ring in a first direction;

a second actuator responsive to a second control pressure and operable to pivot the containment ring or eccentric ring in a second direction;

a control valve responsive to a control pilot pressure to control application of the first fluid pressure to the first actuator, and responsive to a second control pressure to control application of the second fluid pressure to the second actuator; and a vane extension member carried by the housing and engageable with the vanes during at least certain positions of the rotor to ensure that at least one vane extends outwardly from the exterior of the rotor at all times.

27. The variable displacement vane-type fluid pump of claim 26 wherein the first actuator is a chamber formed between a portion of the containment ring and a portion of the housing.

28. A variable displacement vane-type fluid pump, comprising:

a housing defining a pump inlet through which fluid enters the pump, a pump outlet from which fluid is discharged under pressure and a fluid chamber between the pump inlet and pump outlet;

a containment ring or eccentric ring pivotally carried by the housing within the fluid chamber for movement between a first position and a second position, the containment ring or eccentric ring having an interior opening with an internal surface;

a rotor carried by the housing at least in part in the interior opening of the containment ring or eccentric ring, driven for rotation relative to the internal surface and having a plurality of slots extending radially inwardly into the rotor from an exterior of the rotor;

a plurality of vanes carried by the rotor with a vane slidably received in each slot in the rotor;

a first actuator responsive to a first control pressure and operable to pivot the containment ring or eccentric ring toward its first position;

a second actuator responsive to a second control pressure and operable to pivot the containment ring or eccentric ring toward its second position;

a control circuit responsive to engine conditions for providing a variable targeting of pump output wherein pressure from the oil circuit in the engine acts on the first actuator and pressure from the outlet acts on the second actuator for variable control of the containment ring in response to these conditions;

wherein control and positioning of the first and second actuators are a function of a combination of a first pressure signal and a second pressure signal taken from discrete locations separated by a degree of inherent hydraulic resistance in a downstream fluid circuit;

an area defining a fluid chamber formed between the housing and containment ring or eccentric ring with fluid under pressure in the fluid chamber defining the first actuator; and a control valve responsive to the differential between the first pressure signal and the second pressure signal to selectively apply, based on engine conditions, application of fluid under pressure to either the first or second actuator based on engine conditions.

29. The variable displacement vane-type fluid pump of claim 28 wherein the control circuit includes an actuator operatively connected to one of the actuators for moving the containment ring in response to the control pressures.

30. A variable displacement vane pump, comprising:

a housing defining a chamber, a pump inlet through which fluid enters the housing and a pump outlet through which fluid is discharged from the housing under pressure;

a containment ring or eccentric ring pivotally carried by the housing for movement between a first position and a second position and defining an opening with an internal surface;

a rotor carried by the housing for rotation relative to the internal surface and having a plurality of slots extending inwardly into the rotor from an exterior of the rotor;

a plurality of vanes carried by the rotor with each vane slidably received in a slot in the rotor;

a first actuator responsive to application of fluid under pressure and operable to pivot the containment ring or eccentric ring in a first direction;

a second actuator responsive to application of fluid under pressure and operable to pivot the containment ring or eccentric ring in a second direction;

wherein the first and second actuators are fluid acting directly on the containment ring;

wherein control and positioning of the first and second actuators are a function of a combination of a first pressure signal and a second pressure signal taken from discrete locations separated by a degree of inherent hydraulic resistance in a downstream fluid circuit;

an area defining a fluid chamber formed between the housing and containment ring or eccentric ring with fluid under pressure in the fluid chamber defining the first actuator; and a control valve responsive to the differential between the first pressure signal and the second pressure signal to selectively apply, based on engine conditions, application of fluid under pressure to either the first or second actuator based on engine conditions.

31. A variable displacement vane pump, comprising:

a housing defining a chamber, a pump inlet through which fluid enters the housing and a pump outlet through which fluid is discharged from the housing under pressure;

a containment ring or eccentric ring pivotally carried by the housing for movement between a first position and a second position and defining an opening with an internal surface;

a rotor carried by the housing for rotation relative to the internal surface and having a plurality of slots extending inwardly into the rotor from an exterior of the rotor;

a plurality of vanes carried by the rotor with each vane slidably received in a slot in the rotor;

a first actuator responsive to application of fluid under pressure and operable to pivot the containment ring or eccentric ring in a first direction;

a second actuator responsive to application of fluid under pressure and operable to pivot the containment ring or eccentric ring in a second direction;

a seal between the containment ring or eccentric ring and the housing defining a fluid chamber between the housing and containment ring or eccentric ring with fluid under pressure in the fluid chamber defining the first actuator;

another fluid chamber defined at least in part by the seal with fluid under pressure in the another fluid chamber defining the second; and a control valve responsive to the differential between the first pressure signal and the second pressure signal to selectively apply, based on engine conditions, application of fluid under pressure to either the first or second actuator based on engine conditions.

32. The pump of claim 31 which also comprises an inlet flow valve responsive to a fluid pressure signal above a threshold pressure to permit a portion of fluid discharged from the pump outlet to flow into the pump inlet during at least some fluid flow conditions.

33. The pump of claim 32 wherein the inlet flow valve is yieldably biased to a position preventing fluid discharged from the pump outlet to flow into the inlet of the pump and is displaced by a sufficiently high fluid pressure signal to a position permitting fluid discharged from the pump outlet to flow into the pump inlet.

34. The pump of claim 31 which also comprises a vane extension member carried by the housing and engageable with the vanes during at least certain positions of the rotor to ensure that at least two vanes extend outwardly from the exterior of the rotor at all times.

35. The pump of claim 34 wherein the vane extension member is a ring carried by the rotor to engage at least two vanes at all times.

36. The pump of claim 31 wherein the seal is carried by the containment ring or eccentric ring.

37. The pump of claim 33 wherein fluid under pressure is communicated with the slots in the rotor to bias the vanes into contact with the cam surface.

38. The pump of claim 37 wherein the vane extension member further comprises a ring portion for engaging the two rings and oil pressure acting on the vanes for extending the vane outwardly.

39. The pump of claim 33 wherein the inlet flow valve is biased by a spring.

40. The pump of claim 39 wherein the inlet flow valve is further biased by a pilot pressure signal.

41. A variable displacement vane pump, comprising:

a housing defining a chamber, a pump inlet through which fluid enters the housing and a pump outlet through which fluid is discharged from the housing under pressure;

a containment ring or eccentric ring pivotally carried by the housing for movement between a first position and a second position and defining an opening with an internal surface;

a rotor carried by the housing for rotation relative to the internal surface and having a plurality of slots extending inwardly into the rotor from an exterior of the rotor, a plurality of vanes carried by the rotor with each vane slidably received in a slot in the rotor;

a first actuator responsive to application of fluid under pressure and operable to pivot the containment ring or eccentric ring in a first direction;

a second actuator responsive to application of fluid under pressure and operable to pivot the containment ring or eccentric ring in a second direction; and an inlet flow valve responsive to a fluid pressure signal above a threshold pressure to permit a portion of fluid discharged from the pump outlet to flow into the pump inlet during at least some fluid flow conditions.

42. The pump of claim 41 wherein the inlet flow valve is yieldably biased to a position preventing fluid discharged from the pump outlet to flow into the inlet of the pump and is displaced by a sufficiently high fluid pressure signal to a position permitting fluid discharged from the pump outlet to flow into the pump inlet.

43. The pump of claim 41 which also comprises a vane extension member carried by the housing and engageable with the vanes during at least certain positions of the rotor to ensure that at least two vanes extend outwardly from the exterior of the rotor at all times.

44. The pump of claim 43 wherein the vane extension member is a ring carried by the rotor to engage at least two vanes at all times.

45. The pump of claim 41 wherein the slots on the rotor extend radially inwardly of the rotor.

46. The pump of claim 42 wherein fluid under pressure is communicated with the slots in the rotor to bias the vanes into contact with the cam surface.

47. The pump of claim 43 wherein the vane extension member further comprises a ring portion for engaging the two rings and oil pressure acting on the vanes for extending the vane outwardly.

48. The pump of claim 41 wherein the vanes have leading and trailing faces and the slots in the rotor are slightly wider than the vanes received in the slots so that a fluid film forms between the rotor and the leading and trailing faces of each vane.

49. The pump of claim 48 further comprising a seal between a vane and the rotor to restrict fluid flow between them.

50. The pump of claim 49 wherein the seal is formed by contact between the vane and rotor.

51. The pump of claim 42 wherein the inlet flow valve is biased by a spring.

52. The pump of claim 51 wherein the inlet flow valve is further biased by a pilot pressure signal.

53. A variable displacement vane pump, comprising:

a housing defining a chamber, a pump inlet through which fluid enters the housing and a pump outlet through which fluid is discharged from the housing under pressure;

a containment ring or eccentric ring pivotally carried by the housing for movement between a first position and a second position and defining an opening with an internal surface;

a rotor carried by the housing for rotation relative to the internal surface and having a plurality of slots extending inwardly into the rotor from an exterior of the rotor;

a plurality of vanes carried by the rotor with each vane slidably received in a slot in the rotor;

a first actuator responsive to application of fluid under pressure and operable to pivot the containment ring or eccentric ring in a first direction;

a second actuator responsive to application of fluid under pressure and operable to pivot the containment ring or eccentric ring in a second direction; and a vane extension member carried by the housing and engageable with the vanes during at least certain positions of the rotor to ensure that at least two vanes extend outwardly from the exterior of the rotor at all times.

54. The pump of claim 53 wherein the vane extension member is a ring carried by the rotor to engage at least two vanes at all times.

55. The pump of claim 53 wherein the slots on the rotor extend radially inwardly of the rotor.

56. The pump of claim 53 wherein the vane extension member further comprises a ring portion for engaging the two rings and oil pressure acting on the vanes for extending the vane outwardly.

57. The pump of claim 53 wherein the vanes have leading and trailing faces and the slots in the rotor are slightly wider than the vanes received in the slots so that a fluid film forms between the rotor and the leading and trailing faces of each vane.

58. The pump of claim 57 further comprising a seal between a vane and the rotor to restrict fluid flow between them.

59. The pump of claim 58 wherein the seal is formed by contact between the vane and rotor.

60. A variable displacement vane pump, comprising:

a housing defining a chamber, a pump inlet through which fluid enters the housing and a pump outlet through which fluid is discharged from the housing under pressure;

a containment ring or eccentric ring pivotally carried by the housing for movement between a first position and a second position and defining an opening with an internal surface;

a rotor carried by the housing for rotation relative to the internal surface and having a plurality of slots extending inwardly into the rotor from an exterior of the rotor;

a plurality of vanes carried by the rotor with each vane slidably received in a slot in the rotor;

a first actuator responsive to application of fluid under pressure and operable to pivot the containment ring or eccentric ring in a first direction, wherein the first actuator is responsive to a first actuation pressure signal;

a second actuator responsive to application of fluid under pressure and operable to pivot the containment ring or eccentric ring in a second direction, wherein the second actuator is responsive to a second actuation pressure signal;

an area defining a fluid chamber formed between the housing and containment ring or eccentric ring with fluid under pressure in the fluid chamber defining the first actuator; and a control valve responsive to the differential between the first pressure signal and the second pressure signal to selectively apply, based on engine conditions, application of fluid under pressure to either the first or second actuator based on engine conditions.

61. The pump of claim 60 wherein the first actuator is a piston slidably carried by the housing.

62. The variable displacement vane pump of claim 60 wherein the second direction is in a direction opposite of the first direction.

63. The pump of claim 60 wherein the second actuator is a piston slidably carried by the housing.

64. The pump of claim 60 wherein the first actuator includes a spring that in yielding biases the containment ring or eccentric ring in the first direction.

65. The pump of claim 60 which also comprises another fluid chamber defined at least in part by the seal with fluid under pressure in the another fluid chamber defining the second actuator.

66. The pump of claim 60 which also comprises a control valve responsive to a first fluid pressure signal to control application of the fluid under pressure to the first actuator, and responsive to a second fluid pressure signal to control application of the fluid under pressure to the second actuator.

67. The pump of claim 60 which also comprises a pivot pin about which the containment ring or eccentric ring pivots, the pivot pin defining a pivot axis of the containment ring or eccentric ring which is offset from the axis of the rotor by about one-half the maximum eccentricity of the containment ring or eccentric ring relative to the rotor.

68. The pump of claim 60 which also comprises an inlet flow valve responsive to a fluid pressure signal above a threshold pressure to permit a portion of fluid discharged from the pump outlet to flow into the pump inlet during at least some fluid flow conditions.

69. The pump of claim 68 wherein the inlet flow valve is yieldably biased to a position preventing fluid discharged from the pump outlet to flow into the inlet of the pump and is displaced by a sufficiently high fluid pressure signal to a position permitting fluid discharged from the pump outlet to flow into the pump inlet.

70. The pump of claim 60 which also comprises a vane extension member carried by the housing and engageable with the vanes during at least certain positions of the rotor to ensure that at least two vanes extend outwardly from the exterior of the rotor at all times.

71. The pump of claim 70 wherein the vane extension member is a ring carried by the rotor to engage at least two vanes at all times.

72. The pump of claim 60 wherein the slots on the rotor extend radially inwardly of the rotor.

73. The pump of claim 60 wherein the seal is defined by direct contact between the containment ring or eccentric ring and the housing.

74. The pump of claim 60 wherein the seal is carried by the containment ring or eccentric ring.

75. The pump of claim 60 wherein the seal is carried on the housing.

76. The pump of claim 69 wherein fluid under pressure is communicated with the slots in the rotor to bias the vanes into contact with the cam surface.

77. The pump of claim 70 wherein the vane extension member further comprises a ring portion for engaging the two rings and oil pressure acting on the vanes for extending the vane outwardly.

78. The pump of claim 66 which also comprises an exhaust opening in the housing through which fluid in the fluid chamber is discharged under certain fluid flow conditions and wherein the control valve controls fluid flow from the fluid chamber through the exhaust opening in response to certain fluid pressures of the first and second pilot pressures.

79. The pump of claim 60 wherein the vanes have leading and trailing faces and the slots in the rotor are slightly wider than the vanes received in the slots so that a fluid film forms between the rotor and the leading and trailing faces of each vane.

80. The pump of claim 79 further comprising a seal between a vane and the rotor to restrict fluid flow between them.

81. The pump of claim 80 wherein the seal is formed by contact between the vane and rotor.

82. The pump of claim 69 wherein the inlet flow valve is biased by a spring.

83. The pump of claim 82 wherein the inlet flow valve is further biased by a pilot pressure signal.

84. A variable displacement pump system, comprising:

a pump assembly including a pump inlet through which fluid enters the housing and a pump outlet through which fluid is discharged from the pump assembly under pressure;

a first actuator responsive to application of fluid under pressure and operable to cause displacement of the pump assembly towards a first displacement position;

a second actuator responsive to application of fluid under pressure and operable to cause displacement of the pump assembly towards a second displacement position;

wherein control and positioning of the first and second actuators are a function of a combination of a first pressure signal and a second pressure signal taken from discrete locations separated by a degree of inherent hydraulic resistance in a downstream fluid circuit;

an area defining a fluid chamber formed between the housing and containment ring or eccentric ring with fluid under pressure in the fluid chamber defining the first actuator; and a control valve responsive to the differential between the first pressure signal and the second pressure signal to selectively apply, based on engine conditions, application of fluid under pressure to either the first or second actuator based on engine conditions.

85. The pump of claim 84 which also comprises an inlet flow valve responsive to a fluid pressure signal above a threshold pressure to permit a portion of fluid discharged from the pump outlet to flow into the pump inlet during at least some fluid flow conditions.

86. The pump of claim 85 wherein the inlet flow valve is yieldably biased to a position preventing fluid discharged from the pump outlet to flow into the inlet of the pump and is displaced by a sufficiently high fluid pressure signal to a position permitting fluid discharged from the pump outlet to flow into the pump inlet.

87. The pump of claim 84 which also comprises an exhaust opening in the housing through which fluid in the fluid chamber is discharged under certain fluid flow conditions and wherein the control valve controls fluid flow from the fluid chamber through the exhaust opening in response to certain fluid pressure signals of the first and second pilot pressure signals.

88. The pump of claim 86 wherein the inlet flow valve is biased by a spring.

89. The pump of claim 88 wherein the inlet flow valve is further biased by a pilot pressure signal.

90. A variable displacement pump system, comprising:

a pump assembly including a pump inlet through which fluid enters the housing and a pump outlet through which fluid is discharged from the pump assembly under pressure;

a first actuator responsive to application of fluid under pressure and operable to cause displacement of the pump assembly towards a first displacement position; and a second actuator responsive to application of fluid under pressure and operable to cause displacement of the pump assembly towards a second displacement position;

a flow control valve for mechanically varying the pump displacement;

a compression spring connectable at a first spring end to a spool of the flow control valve, wherein the compression spring maintains pressure on the flow control valve during regular operation, and provides return pressure in the absence of a pilot pressure on the flow control valve;

a target piston connected to the second end of the compression spring, wherein the target piston exerts a force on the compression spring;

wherein control and positioning of the first and second actuators are a function of a combination of a first pressure signal and a second pressure signal taken from discrete locations separated by a degree of inherent hydraulic resistance in a downstream fluid circuit acting on the target piston and the flow control valve for providing a variable pressure target for regulation of the pump's displacement in response to varying engine speeds; and an area defining a fluid chamber formed between the housing and containment ring or eccentric ring with fluid under pressure in the fluid chamber defining the first actuator;

wherein the flow control valve is responsive to the differential between the first pressure signal and the second pressure signal to selectively apply, based on engine conditions, application of fluid under pressure to either the first or second actuator based on engine conditions.

91. The pump of claim 90 wherein the target piston is positioned in a bore, the target piston being located on a first side by a pressure from a control input and on a second side by a grounded spring, the position in the bore acting as a reference for a regulation system to provide a predetermined regulation target pressure in the fluid circuit.

92. The pump of claim 91 wherein a multifunctional valve provides for varying the displacement of the pump by directing pressurized fluid to an on-stroke or de-stroke side of the pump assembly in response to the target piston acting on the multifunctional valve in a first direction, and a pressure input from the fluid circuit acting on the multifunctional valve in a second direction.

93. The pump of claim 92 wherein the multifunctional valve is a spool type valve having a biasing spring connected between the target piston and a spool valve, the target piston compressing the spring and biasing the spool valve for providing a target position in response to a control input from the pump assembly, the spool valve having passages for directing a control flow of fluid to the pump assembly, a control pressure from the fluid circuit acting on the spool valve against the biasing spring for seeking a predetermined target pressure.

94. A variable displacement vane pump, comprising:

a housing defining a chamber, a pump inlet through which fluid enters the housing and a pump outlet through which fluid is discharged from the housing under pressure;

a containment ring or eccentric ring pivotally carried by the housing for movement between a first position and a second position and defining an opening with an internal surface;

a rotor carried by the housing for rotation relative to the internal surface and having a plurality of slots extending inwardly into the rotor from an exterior of the rotor;

a plurality of vanes carried by the rotor with each vane slidably received in a slot in the rotor;

a first actuator responsive to application of fluid under pressure and operable to pivot the containment ring or eccentric ring in a first direction;

a second actuator responsive to application of fluid under pressure and operable to pivot the containment ring or eccentric ring in a second direction;

wherein control and positioning of the first and second actuators are a function of a combination of a first pressure signal and a second pressure signal taken from discrete locations separated by a degree of inherent hydraulic resistance in a downstream fluid circuit; and a vane extension member carried by the housing and engageable with the vanes during at least certain positions of the rotor to ensure that at least two vanes extend outwardly from the exterior of the rotor at all times.

95. The pump of claim 94 wherein the first actuator is a piston slidably carried by the housing.

96. The variable displacement vane pump of claim 94 wherein the second direction is in a direction opposite of the first direction.

97. The pump of claim 94 wherein the second actuator is a piston slidably carried by the housing.

98. The pump of claim 94 wherein the first actuator includes a spring that in yielding biases the containment ring or eccentric ring in the first direction.

99. The pump of claim 94 which also comprises a seal between the containment ring or eccentric ring and the housing defining a fluid chamber between the housing and containment ring or eccentric ring with fluid under pressure in the fluid chamber defining the first actuator.

100. The pump of claim 99 which also comprises another fluid chamber defined at least in part by the seal with fluid under pressure in the another fluid chamber defining the second actuator.

101. The pump of claim 94 which also comprises a control valve responsive to a first fluid pressure signal to control application of the fluid under pressure to the first actuator, and responsive to a second fluid pressure signal to control application of the fluid under pressure to the second actuator.

102. The pump of claim 94 which also comprises a pivot pin about which the containment ring or eccentric ring pivots, the pivot pin defining a pivot axis of the containment ring or eccentric ring which is offset from the axis of the rotor by about one-half the maximum eccentricity of the containment ring or eccentric ring relative to the rotor.

103. The pump of claim 94 which also comprises an inlet flow valve responsive to a fluid pressure signal above a threshold pressure to permit a portion of fluid discharged from the pump outlet to flow into the pump inlet during at least some fluid flow conditions.

104. The pump of claim 103 wherein the inlet flow valve is yieldably biased to a position preventing fluid discharged from the pump outlet to flow into the inlet of the pump and is displaced by a sufficiently high fluid pressure signal to a position permitting fluid discharged from the pump outlet to flow into the pump inlet.

105. The pump of claim 94 wherein the vane extension member is a ring carried by the rotor to engage at least two vanes at all times.

106. The pump of claim 94 wherein the slots on the rotor extend radially inwardly of the rotor.

107. The pump of claim 99 wherein the seal is defined by direct contact between the containment ring or eccentric ring and the housing.

108. The pump of claim 99 wherein the seal is carried by the containment ring or eccentric ring.

109. The pump of claim 99 wherein the seal is carried on the housing.

110. The pump of claim 104 wherein fluid under pressure is communicated with the slots in the rotor to bias the vanes into contact with the cam surface.

111. The pump of claim 94 wherein the vane extension member further comprises a ring portion for engaging the two rings and oil pressure acting on the vanes for extending the vane outwardly.

112. The pump of claim 101 which also comprises an exhaust opening in the housing through which fluid in the fluid chamber is discharged under certain fluid flow conditions and wherein the control valve controls fluid flow from the fluid chamber through the exhaust opening in response to certain fluid pressures of the first and second pilot pressures.

113. The pump of claim 94 wherein the vanes have leading and trailing faces and the slots in the rotor are slightly wider than the vanes received in the slots so that a fluid film forms between the rotor and the leading and trailing faces of each vane.

114. The pump of claim 113 further comprising a seal between a vane and the rotor to restrict fluid flow between them.

115. The pump of claim 114 wherein the seal is formed by contact between the vane and rotor.

116. The pump of claim 104 wherein the inlet flow valve is biased by a spring.

117. The pump of claim 116 wherein the inlet flow valve is further biased by a pilot pressure signal.

118. A variable displacement vane pump, comprising:

a housing defining a chamber, a pump inlet through which fluid enters the housing and a pump outlet through which fluid is discharged from the housing under pressure;

a containment ring or eccentric ring pivotally carried by the housing for movement between a first position and a second position and defining an opening with an internal surface;

a rotor carried by the housing for rotation relative to the internal surface and having a plurality of slots extending inwardly into the rotor from an exterior of the rotor;

a plurality of vanes carried by the rotor with each vane slidably received in a slot in the rotor;

a first actuator responsive to application of fluid under pressure and operable to pivot the containment ring or eccentric ring in a first direction;

a second actuator responsive to application of fluid under pressure and operable to pivot the containment ring or eccentric ring in a second direction;

a seal between the containment ring or eccentric ring and the housing defining a fluid chamber between the housing and containment ring or eccentric ring with fluid under pressure in the fluid chamber defining the first actuator; and another fluid chamber defined at least in part by the seal with fluid under pressure in the another fluid chamber defining the second actuator.

119. The pump of claim 118 which also comprises an inlet flow valve responsive to a fluid pressure signal above a threshold pressure to permit a portion of fluid discharged from the pump outlet to flow into the pump inlet during at least some fluid flow conditions.

120. The pump of claim 119 wherein the inlet flow valve is yieldably biased to a position preventing fluid discharged from the pump outlet to flow into the inlet of the pump and is displaced by a sufficiently high fluid pressure signal to a position permitting fluid discharged from the pump outlet to flow into the pump inlet.

121. The pump of claim 118 which also comprises a vane extension member carried by the housing and engageable with the vanes during at least certain positions of the rotor to ensure that at least two vanes extend outwardly from the exterior of the rotor at all times.

122. The pump of claim 121 wherein the vane extension member is a ring carried by the rotor to engage at least two vanes at all times.

123. The pump of claim 118 wherein the seal is carried by the containment ring or eccentric ring.

124. The pump of claim 120 wherein fluid under pressure is communicated with the slots in the rotor to bias the vanes into contact with the cam surface.

125. The pump of claim 124 wherein the vane extension member further comprises a ring portion for engaging the two rings and oil pressure acting on the vanes for extending the vane outwardly.

126. The pump of claim 120 wherein the inlet flow valve is biased by a spring.

127. The pump of claim 126 wherein the inlet flow valve is further biased by a pilot pressure signal.

128. A variable displacement vane pump, comprising:

a housing defining a chamber, a pump inlet through which fluid enters the housing and a pump outlet through which fluid is discharged from the housing under pressure;

a containment ring or eccentric ring pivotally carried by the housing for movement between a first position and a second position and defining an opening with an internal surface;

a rotor carried by the housing for rotation relative to the internal surface and having a plurality of slots extending inwardly into the rotor from an exterior of the rotor;

a plurality of vanes carried by the rotor with each vane slidably received in a slot in the rotor;

a first actuator responsive to application of fluid under pressure and operable to pivot the containment ring or eccentric ring in a first direction, wherein the first actuator is responsive to a first actuation pressure signal;

a second actuator responsive to application of fluid under pressure and operable to pivot the containment ring or eccentric ring in a second direction, wherein the second actuator is responsive to a second actuation pressure signal; and an inlet flow valve responsive to a fluid pressure signal above a threshold pressure to permit a portion of fluid discharged from the pump outlet to flow into the pump inlet during at least some fluid flow conditions.

129. The pump of claim 128 wherein the first actuator is a piston slidably carried by the housing.

130. The variable displacement vane pump of claim 128 wherein the second direction is in a direction opposite of the first direction.

131. The pump of claim 128 wherein the second actuator is a piston slidably carried by the housing.

132. The pump of claim 128 wherein the first actuator includes a spring that in yielding biases the containment ring or eccentric ring in the first direction.

133. The pump of claim 128 which also comprises a seal between the containment ring or eccentric ring and the housing defining a fluid chamber between the housing and containment ring or eccentric ring with fluid under pressure in the fluid chamber defining the first actuator.

134. The pump of claim 133 which also comprises another fluid chamber defined at least in part by the seal with fluid under pressure in the another fluid chamber defining the second actuator.

135. The pump of claim 128 which also comprises a control valve responsive to a first fluid pressure signal to control application of the fluid under pressure to the first actuator, and responsive to a second fluid pressure signal to control application of the fluid under pressure to the second actuator.

136. The pump of claim 128 which also comprises a pivot pin about which the containment ring or eccentric ring pivots, the pivot pin defining a pivot axis of the containment ring or eccentric ring which is offset from the axis of the rotor by about one-half the maximum eccentricity of the containment ring or eccentric ring relative to the rotor.

137. The pump of claim 128 wherein the inlet flow valve is yieldably biased to a position preventing fluid discharged from the pump outlet to flow into the inlet of the pump and is displaced by a sufficiently high fluid pressure signal to a position permitting fluid discharged from the pump outlet to flow into the pump inlet.

138. The pump of claim 128 which also comprises a vane extension member carried by the housing and engageable with the vanes during at least certain positions of the rotor to ensure that at least two vanes extend outwardly from the exterior of the rotor at all times.

139. The pump of claim 138 wherein the vane extension member is a ring carried by the rotor to engage at least two vanes at all times.

140. The pump of claim 128 wherein the slots on the rotor extend radially inwardly of the rotor.

141. The pump of claim 133 wherein the seal is defined by direct contact between the containment ring or eccentric ring and the housing.

142. The pump of claim 133 wherein the seal is carried by the containment ring or eccentric ring.

143. The pump of claim 133 wherein the seal is carried on the housing.

144. The pump of claim 137 wherein fluid under pressure is communicated with the slots in the rotor to bias the vanes into contact with the cam surface.

145. The pump of claim 138 wherein the vane extension member further comprises a ring portion for engaging the two rings and oil pressure acting on the vanes for extending the vane outwardly.

146. The pump of claim 135 which also comprises an exhaust opening in the housing through which fluid in the fluid chamber is discharged under certain fluid flow conditions and wherein the control valve controls fluid flow from the fluid chamber through the exhaust opening in response to certain fluid pressures of the first and second pilot pressures.

147. The pump of claim 128 wherein the vanes have leading and trailing faces and the slots in the rotor are slightly wider than the vanes received in the slots so that a fluid film forms between the rotor and the leading and trailing faces of each vane.

148. The pump of claim 147 further comprising a seal between a vane and the rotor to restrict fluid flow between them.

149. The pump of claim 148 wherein the seal is formed by contact between the vane and rotor.

150. The pump of claim 137 wherein the inlet flow valve is biased by a spring.

151. The pump of claim 150 wherein the inlet flow valve is further biased by a pilot pressure signal.

152. A variable displacement pump system, comprising:

a pump assembly including a pump inlet through which fluid enters the housing and a pump outlet through which fluid is discharged from the pump assembly under pressure;

a first actuator responsive to application of fluid under pressure and operable to cause displacement of the pump assembly towards a first displacement position;

a second actuator responsive to application of fluid under pressure and operable to cause displacement of the pump assembly towards a second displacement position;

wherein control and positioning of the first and second actuators are a function of a combination of a first pressure signal and a second pressure signal taken from discrete locations separated by a degree of inherent hydraulic resistance in a downstream fluid circuit; and an inlet flow valve responsive to a fluid pressure signal above a threshold pressure to permit a portion of fluid discharged from the pump outlet to flow into the pump inlet during at least some fluid flow conditions.

153. The pump of claim 152 which also comprises a control valve responsive to a first and a second pressure signal to control application of fluid pressure to the first and second actuators.

154. The pump of claim 152 wherein the inlet flow valve is yieldably biased to a position preventing fluid discharged from the pump outlet to flow into the inlet of the pump and is displaced by a sufficiently high fluid pressure signal to a position permitting fluid discharged from the pump outlet to flow into the pump inlet.

155. The pump of claim 152 which also comprises an exhaust opening in the housing through which fluid in the fluid chamber is discharged under certain fluid flow conditions and wherein the control valve controls fluid flow from the fluid chamber through the exhaust opening in response to certain fluid pressures of the first and second pilot pressures.

156. The pump of claim 154 wherein the inlet flow valve is biased by a spring.

157. The pump of claim 156 wherein the inlet flow valve is further biased by a pilot pressure signal.

158. A variable displacement pump system, comprising:

a pump assembly including a pump inlet through which fluid enters the housing and a pump outlet through which fluid is discharged from the pump assembly under pressure;

a first actuator responsive to application of fluid under pressure and operable to cause displacement of the pump assembly towards a first displacement position; and a second actuator responsive to application of fluid under pressure and operable to cause displacement of the pump assembly towards a second displacement position;

a flow control valve for mechanically varying the pump displacement;

a compression spring connectable at a first spring end to a spool of the flow control valve, wherein the compression spring maintains pressure on the flow control valve during regular operation, and provides return pressure in the absence of a pilot pressure on the flow control valve; and a target piston connected to the second end of the compression spring, wherein the target piston exerts a force on the compression spring;

wherein control and positioning of the first and second actuators are a function of a combination of a first pressure signal and a second pressure signal taken from discrete locations separated by a degree of inherent hydraulic resistance in a downstream fluid circuit acting on the target piston and the flow control valve for providing a variable pressure target for regulation of the pump's displacement in response to varying engine speeds;

wherein the target piston is positioned in a bore, the target piston being located on a first side by a pressure from a control input and on a second side by a grounded spring, the position in the bore acting as a reference for a regulation system to provide a predetermined regulation target pressure in the fluid circuit.

159. The pump of claim 158 wherein a multifunctional valve provides for varying the displacement of the pump by directing pressurized fluid to an on-stroke or de-stroke side of the pump assembly in response to the target piston acting on the multifunctional valve in a first direction, and a pressure input from the fluid circuit acting on the multifunctional valve in a second direction.

160. The pump of claim 159 wherein the multifunctional valve is a spool type valve having a biasing spring connected between the target piston and a spool valve, the target piston compressing the spring and biasing the spool valve for providing a target position in response to a control input from the pump assembly, the spool valve having passages for directing a control flow of fluid to the pump assembly, a control pressure from the fluid circuit acting on the spool valve against the biasing spring for seeking a predetermined target pressure.

* * * * *

UNITED STATES PATENT AND TRADEMARK OFFICE

CERTIFICATE OF CORRECTION

PATENT NO. : 6,896,489 B2
APPLICATION NO. : 10/021566
DATED : May 24, 2005
INVENTOR(S) : Douglas G. Hunter et al.

It is certified that error appears in the above-identified patent and that said Letters Patent is hereby corrected as shown below:

Drawings,
Replacement drawings were submitted on November 15, 2004, but not used for the issued patent. Please replace with attached proper drawings.

Title Page,
Item [56], References Cited, FOREIGN PATENT DOCUMENTS, add

| | | |
|---|---|---|
| -- | DE 38 40 909 | 6/1989 |
| | DE 39 25 249 | 3/1990 |
| | DE 42 42 871 | 6/1994 |
| | DE 101 41 786 | 3/2003 |
| | DE 44 44 819 | 6/1996 |
| | DE 101 44 693 | 3/2003 --. |

Column 8,
Line 39, “passages 139 blind bore 132” should be --passages 139, blind bore 132--.

Column 11,
Line 40, Claim 3, “wherein said” should be --wherein the said--.

Column 11,
Line 51, Claim 7, “by seal” should be --by the seal--.

Column 12,
Line 32, Claim 19, “of said first” should be --of the first--.

Column 12,
Line 36, Claim 20, “in said slots” should be -- in the slots --.

Column 12,
Line 39, Claim 21, “comprises” should be -- comprising --.

Column 13,
Line 13, Claim 25, “fluid;” should be -- fluid circuit; --.

Column 13,
Line 14, Claim 25, “fluid chamber form d” should be -- fluid chamber formed --.

UNITED STATES PATENT AND TRADEMARK OFFICE

CERTIFICATE OF CORRECTION

PATENT NO. : 6,896,489 B2
APPLICATION NO. : 10/021566
DATED : May 24, 2005
INVENTOR(S) : Douglas G. Hunter et al.

It is certified that error appears in the above-identified patent and that said Letters Patent is hereby corrected as shown below:

Column 15,
Line 33, Claim 31, "second;" should be -- second actuator; --.

Signed and Sealed this

Fourteenth Day of August, 2007

JON W. DUDAS
*Director of the United States Patent and Trademark Office*